US011852427B2

(12) United States Patent
Bachstein et al.

(10) Patent No.: US 11,852,427 B2
(45) Date of Patent: Dec. 26, 2023

(54) FIREARM

(71) Applicant: BLACKPOWDER PRODUCTS, INC., Lawrenceville, GA (US)

(72) Inventors: Kyle J. Bachstein, Wake Forest, NC (US); Kathryn Hack, Farmington, NH (US); Jesse Carr, Fremont, NH (US); Michael Guttridge, Boise, ID (US)

(73) Assignee: Blackpowder Products, Inc., Lawrenceville, GA (US)

( * ) Notice: Subject to any disclaimer, the term of this patent is extended or adjusted under 35 U.S.C. 154(b) by 0 days.

(21) Appl. No.: 17/874,675

(22) Filed: Jul. 27, 2022

(65) Prior Publication Data

US 2022/0373281 A1 Nov. 24, 2022

Related U.S. Application Data

(62) Division of application No. 17/145,502, filed on Jan. 11, 2021, now Pat. No. 11,428,484.

(60) Provisional application No. 62/962,395, filed on Jan. 17, 2020.

(51) Int. Cl.

| | |
|---|---|
| ***F41A 15/00*** | (2006.01) |
| ***F41A 11/02*** | (2006.01) |
| ***F41A 3/66*** | (2006.01) |
| ***F41G 1/26*** | (2006.01) |
| ***F41C 27/00*** | (2006.01) |
| ***F41A 21/48*** | (2006.01) |

(52) U.S. Cl.

CPC ..... *F41A 11/02* (2013.01); *F41A 3/66* (2013.01); *F41A 15/00* (2013.01); *F41A 21/488* (2013.01); *F41C 27/00* (2013.01); *F41G 1/26* (2013.01)

(58) Field of Classification Search

CPC ..... F41A 15/00

See application file for complete search history.

(56) References Cited

U.S. PATENT DOCUMENTS

| | | | | | |
|---|---|---|---|---|---|
| 2,198,610 | A | * | 4/1940 | Garand | F41A 15/14 42/25 |
| 2,624,969 | A | * | 1/1953 | Ruger | F41A 19/13 42/16 |
| 3,851,416 | A | * | 12/1974 | Engstrom | F41A 15/00 42/106 |
| 3,882,625 | A | * | 5/1975 | Tellie | F41A 15/14 42/25 |
| 4,606,131 | A | | 8/1986 | Domian | |
| 4,615,132 | A | * | 10/1986 | Smith | F41A 15/14 42/75.01 |
| 4,628,611 | A | | 12/1986 | Ruffino | |
| 4,676,017 | A | * | 6/1987 | Hurlemann | F41A 15/14 42/25 |
| 4,883,213 | A | * | 11/1989 | Almeras | B25C 1/105 227/10 |
| 5,678,340 | A | * | 10/1997 | Moon | F41A 15/12 42/25 |
| 5,794,373 | A | * | 8/1998 | Moon | F41A 15/12 42/25 |

(Continued)

*Primary Examiner* — Derrick R Morgan

(74) *Attorney, Agent, or Firm* — Gardner Groff & Greenwald, P.C.

(57) ABSTRACT

Improved firearms including one or more of a removable and/or interchangeable top cover, an improved extractor mechanism, a striker safety mechanism with a direct trigger interface, a sear with direct striker interface, and/or a striker with integral striker spring retention features.

10 Claims, 19 Drawing Sheets

(56) References Cited

U.S. PATENT DOCUMENTS

| | | | | |
|---|---|---|---|---|
| 6,389,725 | B1 * | 5/2002 | Denuit | F41A 9/56 42/25 |
| 6,393,751 | B1 * | 5/2002 | Liebenberg | F41A 3/64 42/75.01 |
| 6,718,680 | B2 | 4/2004 | Roca | |
| 8,984,787 | B1 * | 3/2015 | O'Clair | F41A 15/14 42/25 |
| 9,285,186 | B1 | 3/2016 | Di Veroli | |
| 9,599,417 | B2 * | 3/2017 | Kolev | F41A 3/66 |
| 10,024,628 | B2 | 7/2018 | Toner | |
| 10,876,815 | B1 | 12/2020 | Wingfield | |
| 10,907,918 | B2 * | 2/2021 | Curry | F41A 15/14 |
| 11,067,348 | B1 * | 7/2021 | Ribic | F41G 1/30 |
| 11,112,214 | B2 | 9/2021 | Niswander | |
| 11,428,484 | B2 | 8/2022 | Bachstein | |
| 2005/0132875 | A1 | 6/2005 | Murello | |
| 2014/0137454 | A1 * | 5/2014 | Lee | F41A 19/36 42/25 |
| 2014/0165446 | A1 | 6/2014 | Rozic | |
| 2014/0196339 | A1 * | 7/2014 | Zukowski | F41A 3/12 42/25 |
| 2015/0241175 | A1 | 8/2015 | Wolf | |
| 2015/0276350 | A1 | 10/2015 | Zimmer | |
| 2015/0369553 | A1 * | 12/2015 | Stussak | F41A 15/16 42/25 |
| 2017/0059277 | A1 | 3/2017 | Justice | |
| 2017/0261279 | A1 * | 9/2017 | Lee | F41A 19/36 |
| 2018/0087871 | A1 | 3/2018 | Toner | |
| 2018/0187994 | A1 | 7/2018 | Carr | |
| 2018/0202770 | A1 | 7/2018 | Pniel | |
| 2019/0226784 | A1 * | 7/2019 | Davis | F41A 15/12 |
| 2019/0331461 | A1 | 10/2019 | Zimmer | |
| 2020/0025520 | A1 | 1/2020 | Niswander | |
| 2020/0263946 | A1 * | 8/2020 | Fernandez | F41A 21/12 |
| 2021/0033369 | A1 | 2/2021 | Shawley | |
| 2021/0215457 | A1 | 7/2021 | White | |
| 2021/0222978 | A1 | 7/2021 | Bachstein | |
| 2021/0231407 | A1 | 7/2021 | Salinas | |
| 2021/0254933 | A1 | 8/2021 | Langdon | |
| 2021/0270572 | A1 | 9/2021 | Dawson, Jr. | |
| 2021/0364244 | A1 * | 11/2021 | Kling | F41A 15/14 |
| 2023/0021598 | A1 * | 1/2023 | Santa | F41A 15/16 |

* cited by examiner

FIREARM

CROSS-REFERENCE TO RELATED APPLICATION

This application is a divisional of U.S. Non-Provisional patent application Ser. No. 17/145,502 filed Jan. 11, 2021, which claims the benefit of U.S. Provisional Patent Application Ser. No. 62/962,395 filed Jan. 17, 2020, the entireties of which are hereby incorporated herein by reference for all purposes.

TECHNICAL FIELD

The present invention relates generally to the field of firearms, and more particularly to firearms incorporating improvements to manufacturability, sight interchangeability, extractor function, striker safety, trigger, sear, striker, and/or striker spring components and operation.

BACKGROUND

Continuing improvements are sought in the field of firearms technology. Example embodiments of the present invention are primarily directed to the provision of improvements in manufacturability, sight interchangeability, extractor function, striker safety, trigger, sear, striker, and/or striker spring components and operation of firearms.

SUMMARY

In example embodiments, the present invention provides improvements to various aspects of firearm technology. In particular examples, the invention provides improvements in manufacturability, sight interchangeability, extractor function, striker safety, trigger, sear, striker, and/or striker spring components and operation of firearms.

In example aspects, the present invention relates to an improved firearm, and to various features, components and systems for firearms, which may include one or more of a removable and/or interchangeable top cover, an improved extractor mechanism, a striker safety mechanism with a direct trigger interface, a sear with direct striker interface, and/or a striker with integral striker spring retention and driving features, and any combinations thereof.

In one aspect, the present invention relates to an improved firearm including a slide cover removably connected to a slide of the firearm, an extractor mechanism, a striker safety mechanism, a firearm sear with direct striker interface, and a striker or firing pin.

In another aspect, the present invention relates to an improved firearm including a slide and a slide cover removably connected to the slide, the slide cover including an upper side, a lower side configured for removable engagement with a portion of the slide, and a rear end including a yoke configured for removable engagement with a portion of the slide, wherein the upper side includes an engagement portion configured for removable interchangeable engagement with one or more sights or aiming devices of various formats.

In example embodiments, the upper side of the slide cover includes one or more mounting studs and/or threaded bores, the one or more mounting studs and/or threaded bores being configured and formatted to provide for secure and removable engagement with the sight or aiming device. In example embodiments, the sight or aiming device includes a Delta-Point Pro™ red dot sight by Leupold™. In example embodiments, the sight or aiming device includes an RMR™ red dot sight by Trijicon™. In example embodiments, at least a portion of the sight or aiming device is at least partially integrally formed with a portion of the slide cover. In example embodiments, a roll pin removably secures the yoke of the rear end of the slide cover to the slide. In example embodiments, the slide cover provides access to interior portions of the firearm for manufacture and maintenance, for interchangeability of mounting platforms for different sight configurations, and to provide a clean finish and attractive aesthetic.

In another aspect, the present invention relates to an extractor mechanism for a firearm. In example embodiments, the firearm includes a barrel extending along a longitudinal axis, a grip, a receiver/frame, a slide, a trigger, one or more sights, and an internal magazine. In example embodiments, the extractor mechanism includes a body portion pivotally mounted to the firearm slide for pivotal motion about a pivot axis extending through a proximal lobe of the body portion, an extractor spring attached to a distal lobe of the body, and an elongated extractor arm extending obliquely forward from the body portion to a free end terminating in an extractor hook including a tip, thereby defining a longitudinal moment arm. In example embodiments, the pivot axis is oriented generally transverse relative to the longitudinal bore axis defined by the barrel. In example embodiments, the distal lobe of the body is positioned at a lateral offset distance from the pivot axis to define an extractor spring moment arm. In example embodiments, the extractor hook is configured for engagement with a rim of a cartridge to retract the same rearwardly for extraction from the barrel of the firearm.

In example embodiments, the pivot axis of the body portion of the extractor mechanism is positioned on a first side of the longitudinal bore axis and the point of engagement of the tip of the extractor hook with the cartridge is on an opposite second side of the longitudinal bore axis, and wherein a force vector applied by the extractor hook on the cartridge pulls across and into the body of the cartridge. In example embodiments, the direction of the force vector pulling across and into the body of the cartridge provides an increased and more positive engagement of the cartridge by the extractor such that an increase in the retraction force applied results in an increased engagement area on the cartridge, increased engagement force, increased engagement force on the cartridge promoting maximum engagement area, and/or improved transfer of extraction force to the cartridge, thereby reducing the potential for disengagement and extraction and/or ejection failure. In example embodiments, the proximal lobe and pivot axis thereof are integrally formed with the body portion. In example embodiments, the proximal lobe and/or pivot axis of the body portion are separate components assembled with the body portion. In example embodiments, the body portion is generally triangular in shape.

In yet another aspect, the present invention relates to a striker safety mechanism for a firearm. In example embodiments, the firearm includes a barrel extending along a longitudinal bore axis, a receiver/frame, a slide, a trigger and a striker/firing pin. In example embodiments, the striker safety mechanism includes a striker safety block including a first end, a second end, a forward side and a rearward side, a central body portion defined between the first and second ends and defining a pivot, a striker engagement lobe portion provided at the first end of the block on the rearward side of the pivot, a trigger engagement lobe portion at an opposite second end of the block on the forward side of the pivot, and a striker safety spring configured to bias the striker safety block to pivot the striker engagement portion into abutment with a stop surface or shoulder formed in or on the firing pin to prevent the striker from moving forward and thereby prevent firing of the firearm when the trigger is not pulled.

In example embodiments, when the trigger is pulled, an upper finger extending from the trigger directly contacts the trigger engagement portion, thereby overcoming the bias of striker safety spring and pivoting the striker safety block to move the striker engagement portion out of engagement with the stop surface of the firing pin, allowing the firing pin to advance and fire the firearm. In example embodiments, the trigger engagement lobe portion includes a lower extension portion having an upper finger engagement surface for contact by an upper finger of the trigger.

In yet another aspect, the present invention relates to a firearm sear including a forward portion, an elongated rearward portion defining a shallow ramp and catch adjacent thereto, and a pivot axis generally defined between the forward and rearward portions for pivotally mounting the sear within a portion of a firearm, the elongated rearward portion being biased upwardly by a sear spring, wherein an extension finger of a striker is configured for precise and consistent engagement with the catch of the sear, thereby providing a consistent trigger pull and improved accuracy.

In example embodiments, actuation of a trigger causes movement of a trigger bar, thereby causing pivotal movement of the sear to overcome the bias of the sear spring and disengage the catch from an extension finger of a striker so as to permit forward movement of the striker to strike a cartridge and detonate the same, thereby causing a slide of the firearm to move rearwardly in which the elongated rearward portion is biased upwardly by the sear spring, and wherein the returning forward movement of the slide causes at least some engagement of the extension finger of the striker with the shallow ramp, thereby actuating the elongated rearward portion in a downward pivot motion so as to cause precise and consistent seating of the extension finger with the catch of the sear, thereby maintaining the striker in a cocked position. In example embodiments, the trigger bar includes a first end pivotally mounted to a portion of the trigger and a second end including a release finger, the release finger configured for contacting a release of the sear so as to cause the sear to pivot and disengage the extension finger from the catch of the sear.

In another aspect, the present invention relates to a striker for a firearm including a generally elongate member including a forward end, a rearward end including a rear spring abutment face, one or more integral spring retention members extending from the elongate member, and a striker spring retained between the rear spring abutment face and the one or more integral spring retention members.

In example embodiments, a pair of two radially outwardly projecting spring retention members are integrally formed with the striker on laterally opposite locations toward a forward end of the striker, wherein the spring retention members optionally include a ramped first side face and a flat circumferentially aligned contact face for engagement with the striker spring during installation and use. In example embodiments, at least one end of the striker spring includes a dead end coil configured for abutment with the flat circumferentially aligned contact face of the outwardly projecting spring retention members, wherein the dead end coil prevents unintentional removal of the striker spring from the striker.

These and other aspects, features and advantages of the invention will be understood with reference to the drawing figures and detailed description herein and will be realized by means of the various elements and combinations particularly pointed out in the appended claims. It is to be understood that both the foregoing general description and the following brief description of the drawings and detailed description of example embodiments are explanatory of example embodiments of the invention, and are not restrictive of the invention, as claimed.

BRIEF DESCRIPTION OF THE DRAWINGS

FIGS. 6B-6D shows the cross-sectional view of the firearm having a firearm sear with direct striker interface of FIG. 6A, showing a sequence of operation of the firearm sear and direct striker interface, showing disengagement of the firearm sear with the striker so as to permit forward movement of the striker, and further showing retraction of the striker and other firearm portions and repositioning of the firearm sear.

DETAILED DESCRIPTION OF EXAMPLE EMBODIMENTS

The present invention may be understood more readily by reference to the following detailed description of example embodiments taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
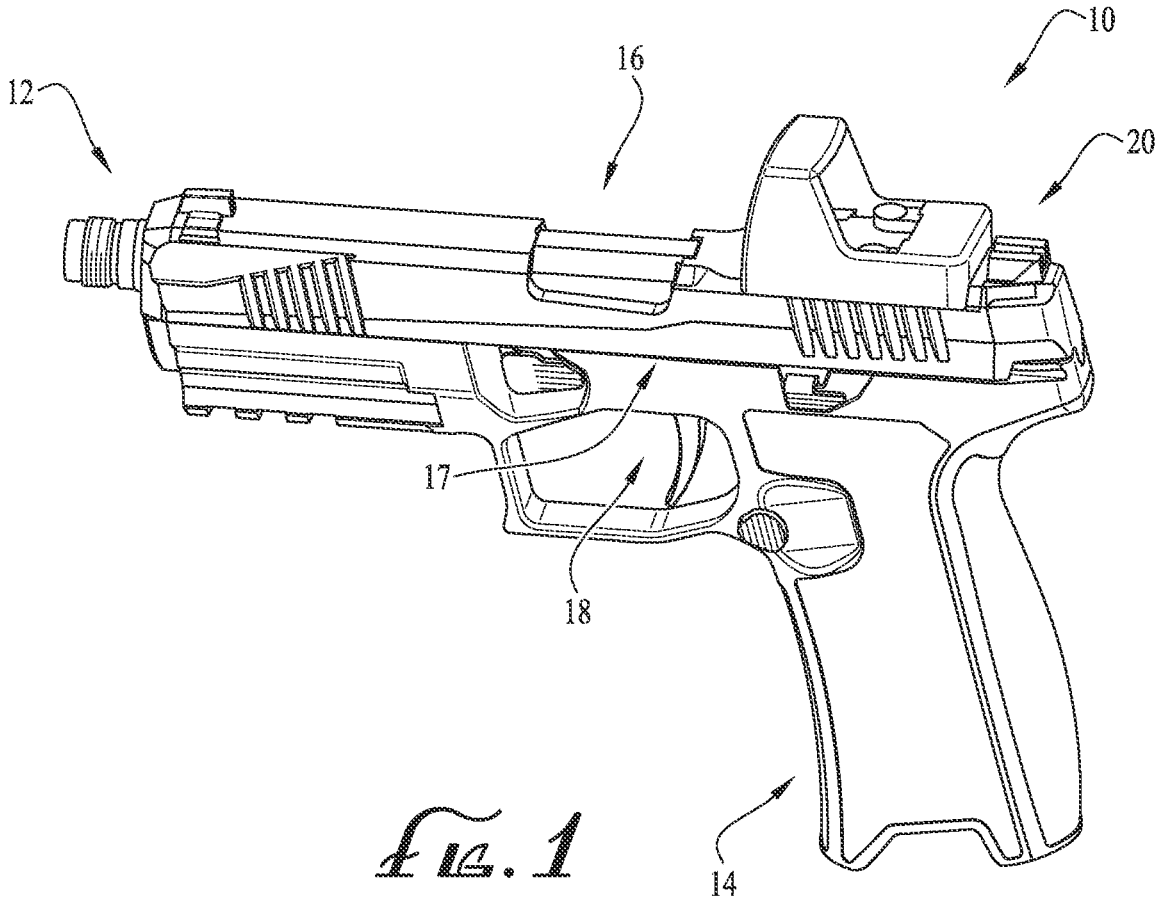
FIG. 1 is a perspective view of a firearm according to an example embodiment of the present invention.

With reference now to the drawing figures, wherein like reference numbers represent corresponding parts throughout the several views, FIG. 1 shows an example embodiment of a firearm 10 according to the present invention. In the depicted embodiment, the firearm 10 takes the form of a semi-automatic pistol or handgun. In alternate embodiments, the firearm may take other forms, including without limitation a rifle, carbine, shotgun, submachinegun, machinegun, or other pistol format. In the depicted embodiment, the firearm 10 generally comprises a barrel 12, a grip 14, a receiver/frame 16 (internal), a slide 17, a trigger 18, one or more sights 20, and an internal magazine.

FIGS. 2A-2G show a removable slide cover or top cover 210 according to an example embodiment of the present invention. In example embodiments, the top cover 210 is configured to provide access to interior portions of the firearm 10 for manufacture and maintenance, for interchangeability of mounting platforms for different sight configurations, and to provide a clean finish and attractive aesthetic. In example embodiments, the removable top cover 210 allows interior access within the body or frame of the firearm 10 for machining and installation of parts during manufacture, and for maintenance and customization. According to one example embodiment, the slide cover comprises an upper side, a lower side configured for removable engagement with a portion of the slide, and a rear end comprising a yoke or fork configured for removable engagement with a portion of the slide (via tension or roll pin 230). In example embodiments, the upper side comprises an engagement portion configured for removable and interchangeable engagement with one or more sights or aiming devices of various formats.

Figure 2A:
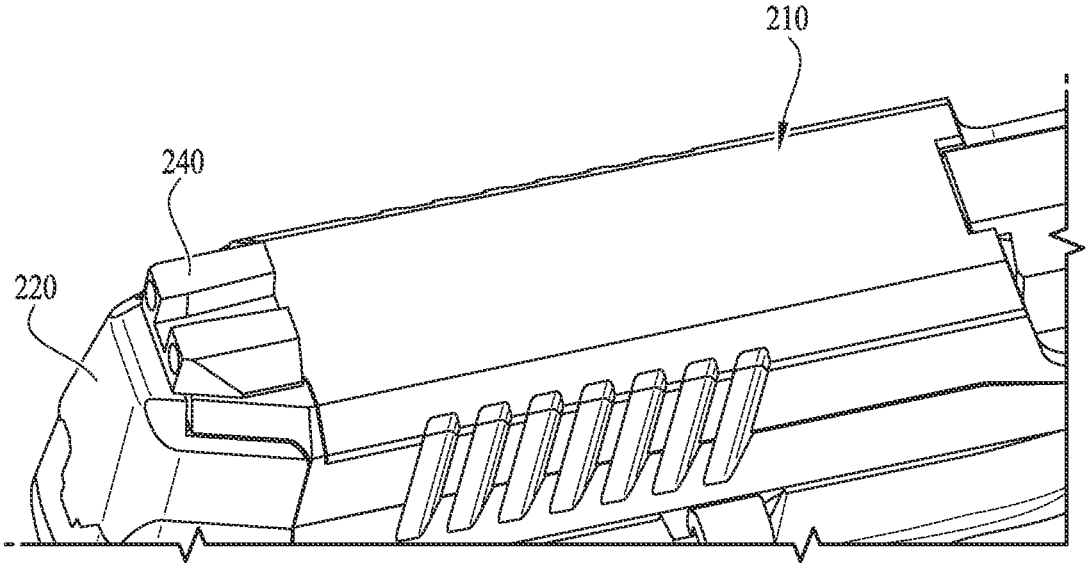
FIGS. 2A-2D shows a removable top cover providing access to interior portions of the firearm for manufacture and maintenance, and for interchangeability of mounting platforms for different sight configurations according to an example embodiment of the present invention.
Figure 2B:
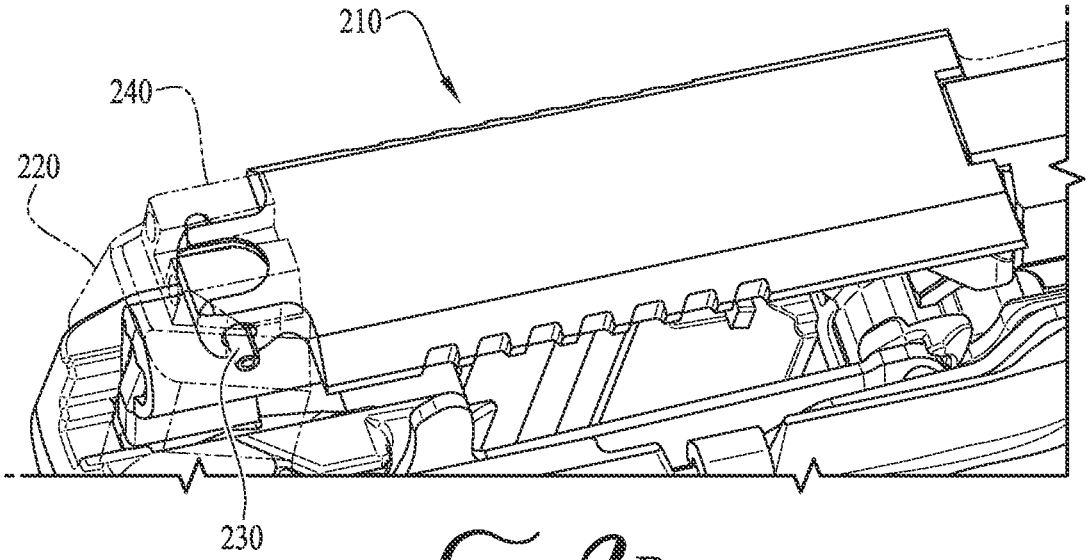
Figure 2C:
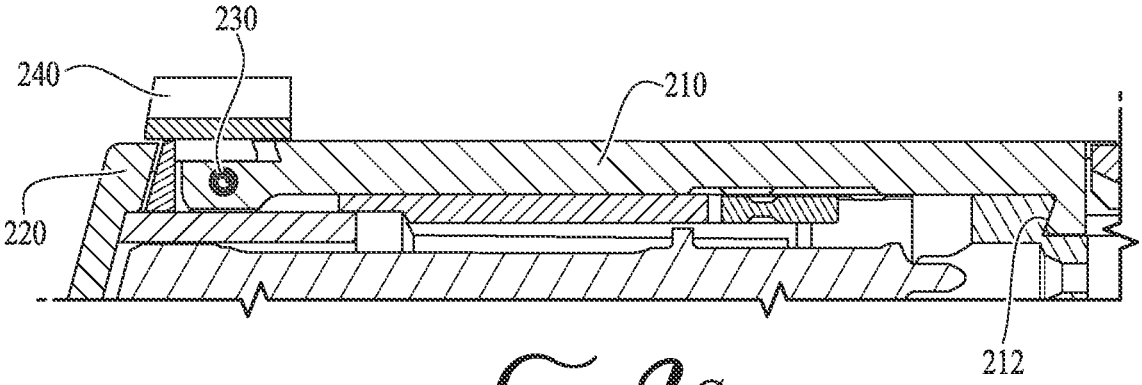
Figure 2D:
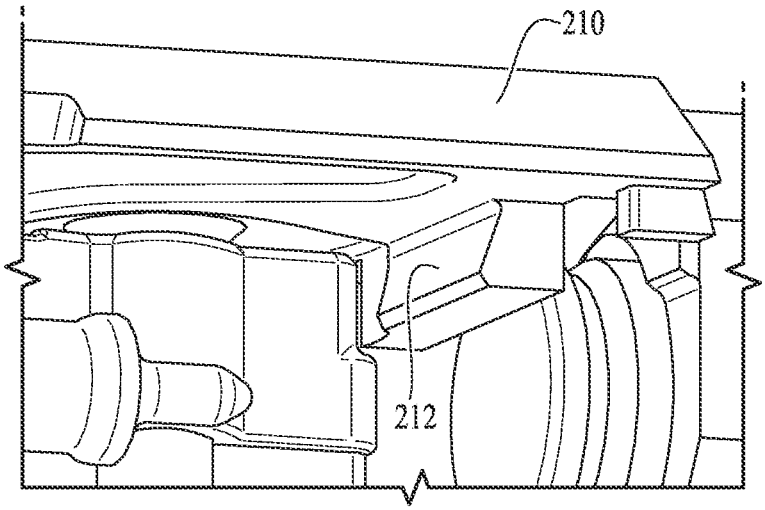
Figure 2E:
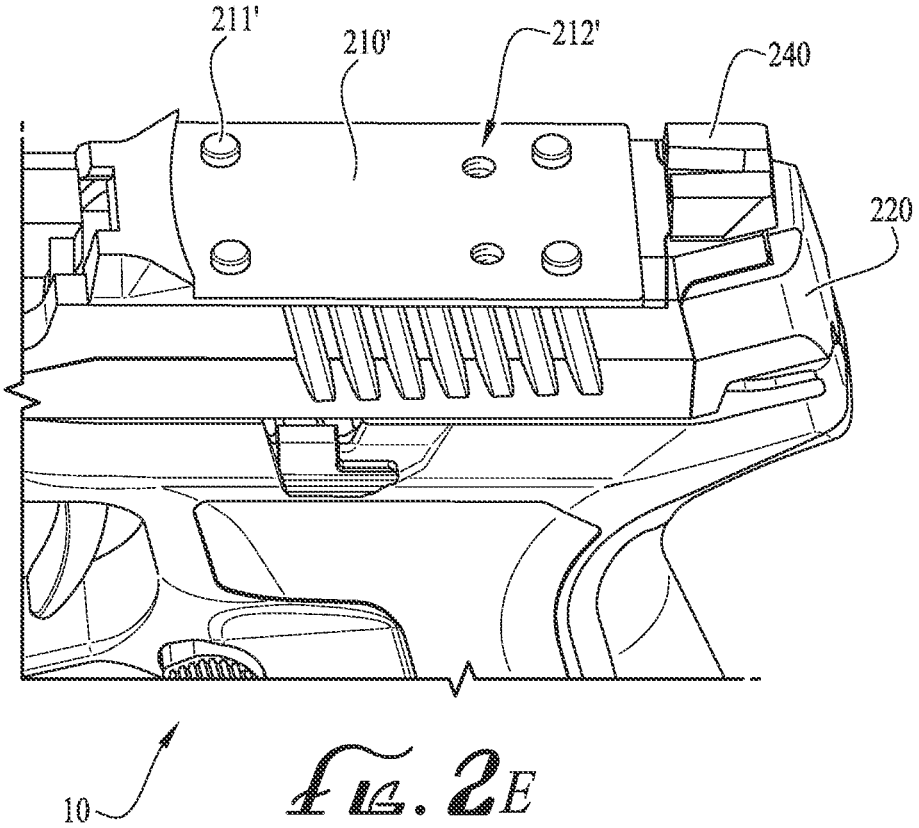
FIG. 2E shows a removable top cover for interchangeability of mounting platforms for different sight configurations according to another example embodiment of the present invention.
Figure 2F:
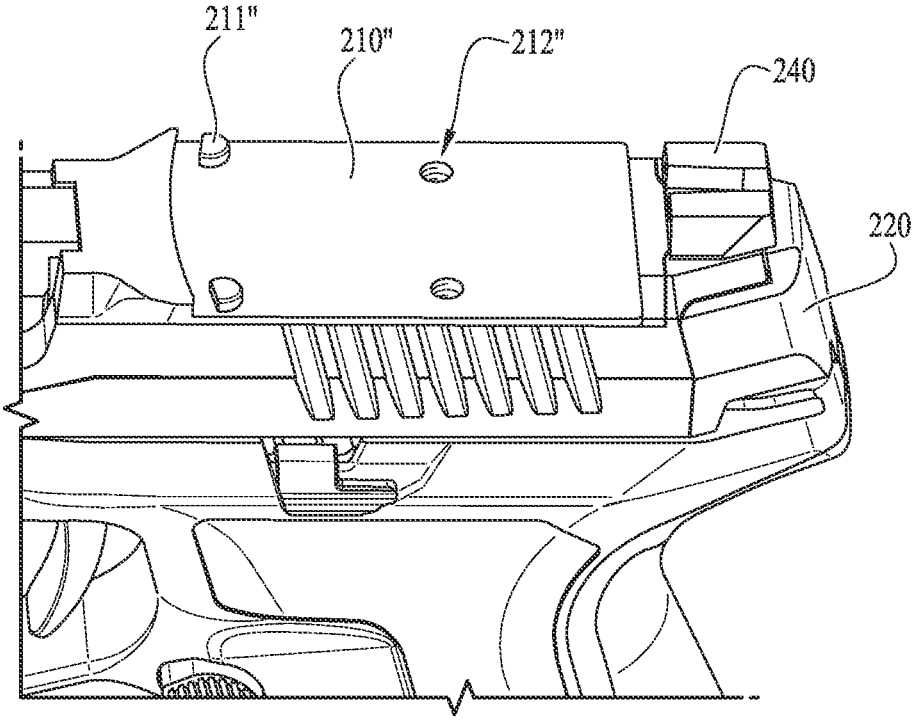
FIG. 2F-2G shows a removable top cover providing access to interior portions of the firearm for manufacture and maintenance, and for interchangeability of mounting platforms for different sight configurations according to another example embodiment of the present invention.
Figure 2G:
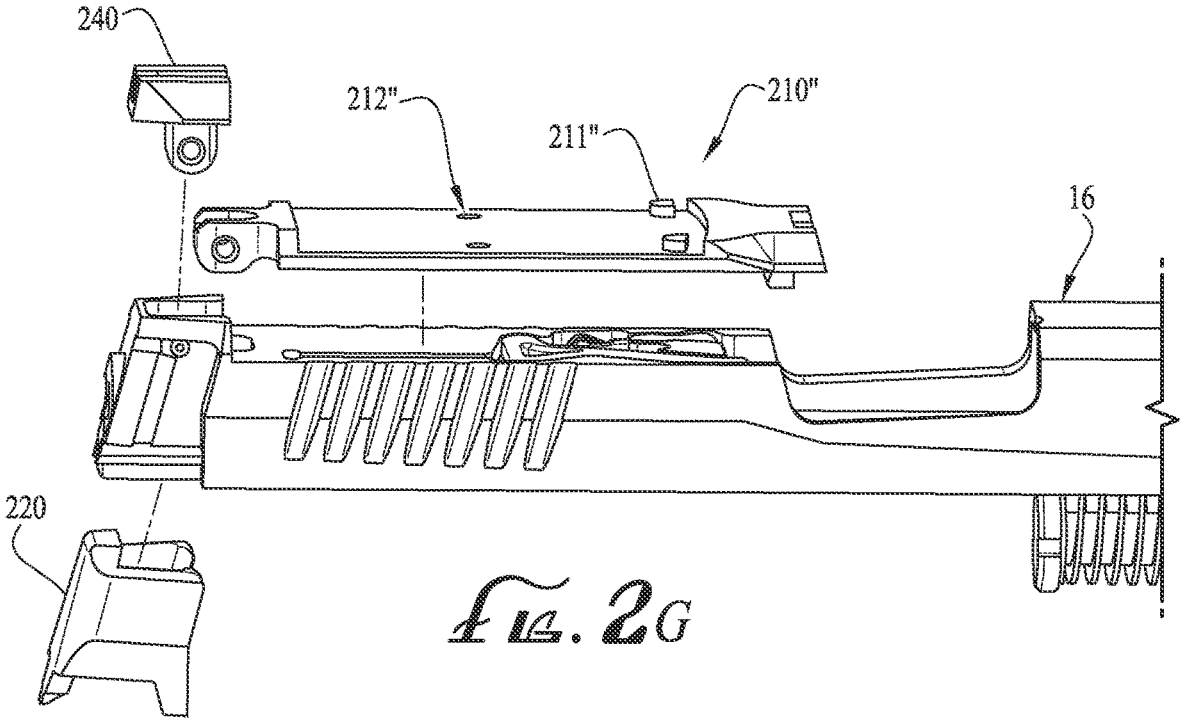

According to example embodiments, two or more configurations or formats of the top cover 210 may be provided for interchangeable removal and installation onto the firearm 10, for interchangeable compatibility with different firearm sight formats. For example, FIG. 2E shows an alternative top cover 210' with mounting studs 211' and threaded bores 212' that are configured for compatibility with a DeltaPoint Pro™ (DPP™) red dot sight by Leupold™. According to another example embodiment, FIGS. 2F-G show another alternative top cover 210" with mounting studs 211" and threaded bores 212" that are configured for compatibility with an RMR™ red dot sight by Trijicon™. In some alternate embodiments, the top cover 210 may comprise an integral sight or aiming device. In other alternate embodiments, the top covers 210, 210', 210" can be configured as desired, for example, to comprise a desired mounting configuration, for example, wherein one or more engagement/mount features (or compatible interengagement features or couplings) are positioned to provide a desired compatible engagement with a desired firearm sight or other component or accessory.

In example methods of use, the top covers 210, 210', 210" can be removed by a user by sliding the rear endcap 220 down and away to remove it from the firearm (see FIG. 2G). The tension pin or roll pin 230 is pressed or tapped to drive it laterally out of engagement with the top cover, rear sight, and slide of the firearm 10. The top cover 210 is removed by sliding it forward to disengage a dovetail projection 212 (see FIG. 2D) at the forward end of the cover from the slide and lifting the top cover away to remove it from the firearm 10. The rear iron sight 240 is then removed by sliding it rearwards and out. The top cover 210, or an alternative format top cover such as for example cover 210' or cover 210" can be interchangeably installed by the reverse procedure.

Figure 2H:
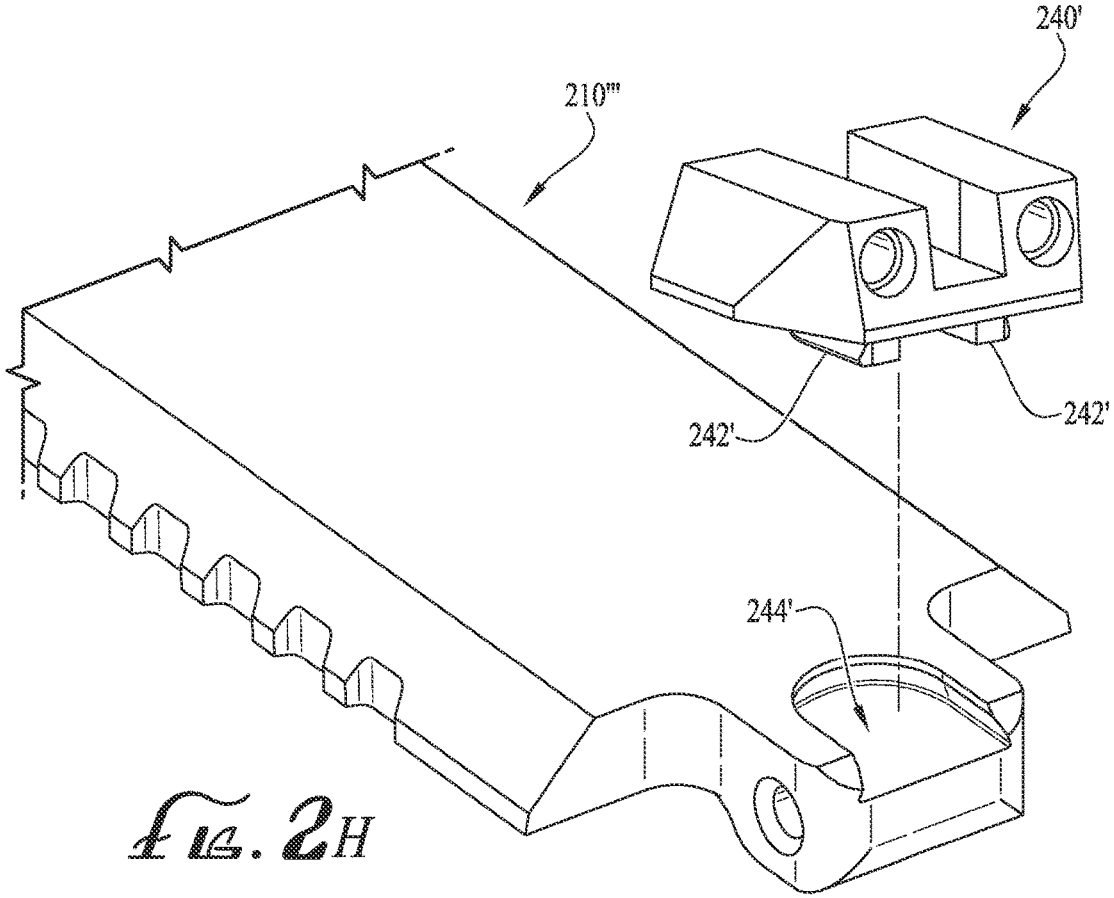
FIGS. 2H-2J show perspective, side and end assembly views of a removable top cover and rear sight according to another example embodiment of the present invention.
Figure 2I:
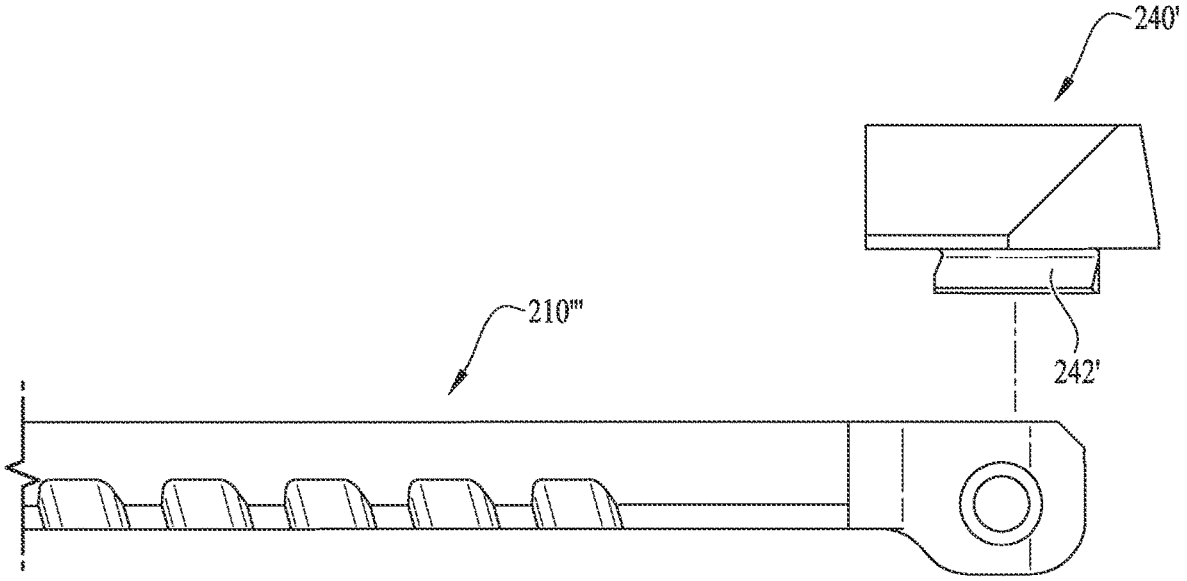
Figure 2J:
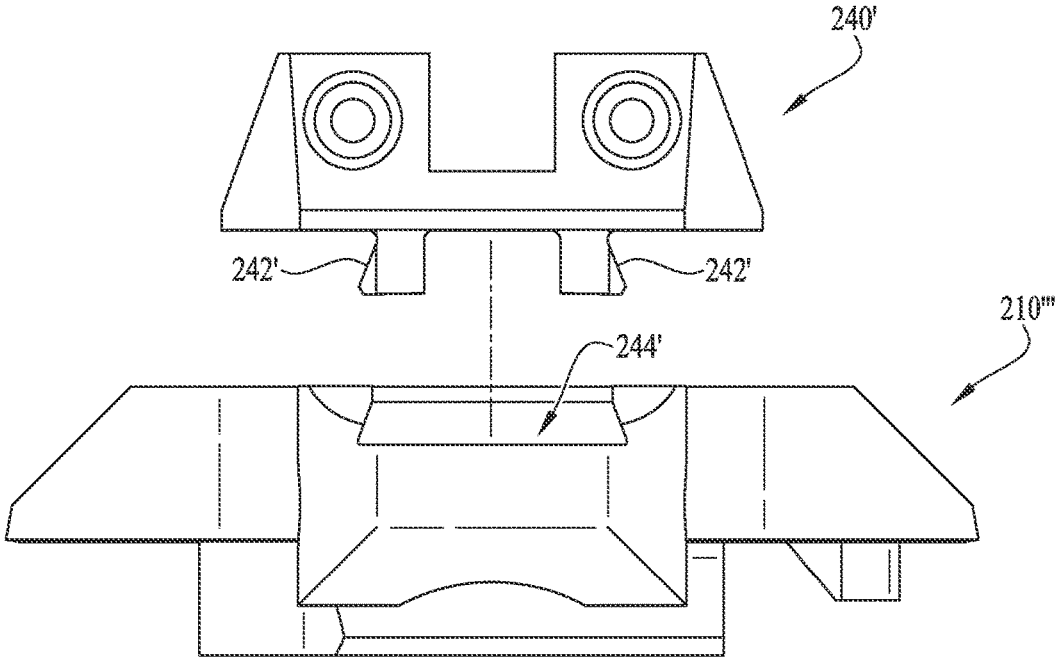

According to another example embodiment, a top cover 210'", which is generally similar to the top cover 210, is similarly configured for compatible fitting engagement with the slide of the firearm 10, and a rear sight 240' is configured for compatible engagement with a portion thereof (see FIG. 2H-FIG. 2J). According to example embodiments, a lower side of the rear sight 240' comprises a pair of dovetail projections 242' that are configured for sliding coupling engagement with a recess or dovetailed receiver 244' formed at a rear end of the top cover 210'". Thus, according to example embodiments, the rear sight can be configured for a pinned engagement (FIG. 2G) or a dovetailed engagement (FIG. 2H-FIG. 2J). In alternate example embodiments, the firearm 10 may not have a rear sight whatsoever, or for example, the rear sight can be configured for coupling engagement by various other features, interengagement members, compatible coupling components, magnetic components, and/or other features as desired.

Figure 3A:
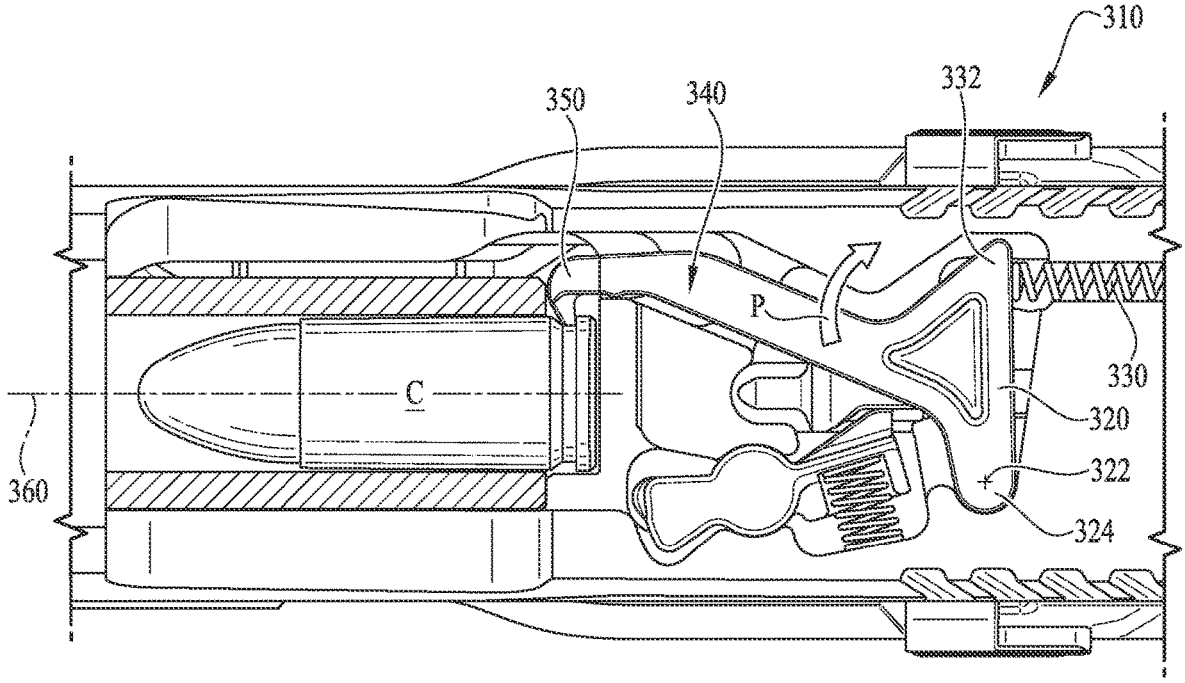
FIGS. 3A-3C show an improved extractor configuration for a firearm according to an example embodiment of the present invention.

According to another example embodiment, the present invention relates to an improved extractor mechanism 310 for extracting cartridges or spent cartridge shells or casings C from the chamber of a firearm 10 and discharging the cartridge or shell from the ejection port of the slide/receiver upon firing or manual actuation or racking of the firearm's action. As depicted in FIG. 3A, the extractor mechanism 310 includes a generally triangular body portion 320 pivotally mounted to the firearm slide for pivotal motion (indicated by direction arrow P) about a pivot axis 322 extending through a proximal lobe 324 of the body portion. In alternate embodiments the body portion could be any shape (e.g. "L" shaped or straight) and can take many shapes but in the depicted embodiment is generally triangular. An extractor spring 330 is attached to or bears against a distal lobe 332 of the body 320 positioned at a lateral offset distance from the pivot axis 322 to define an extractor spring moment arm (see FIG. 3F). In alternate embodiments the spring can be of another type (e.g. leaf, hydraulic, or even be a feature of the component).

Figure 3B:
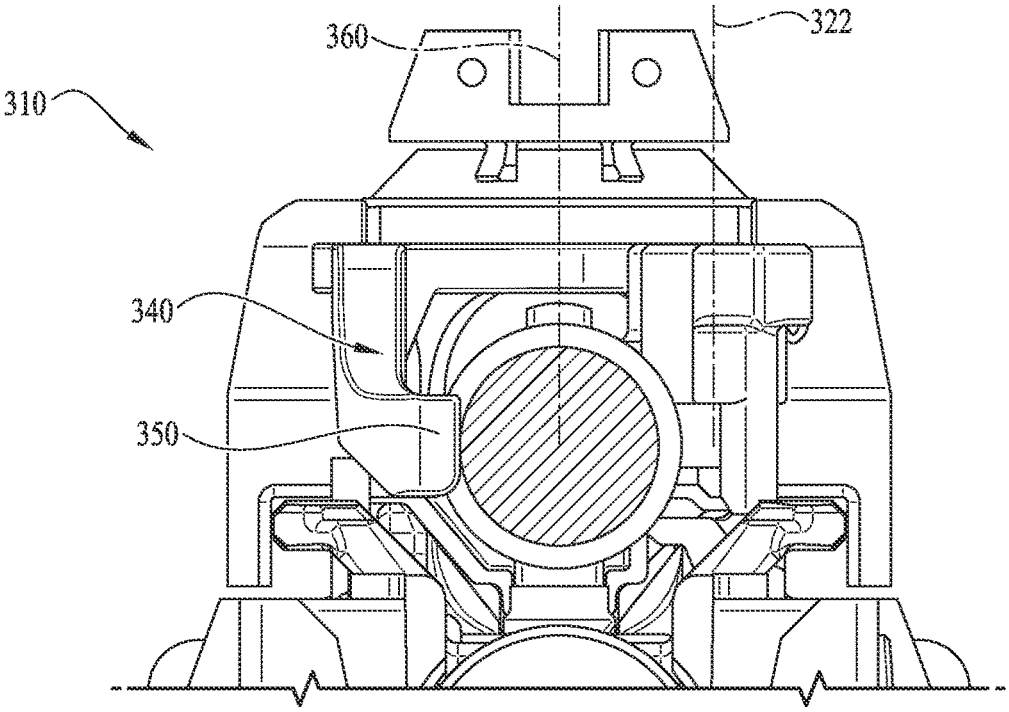
Figure 3C:
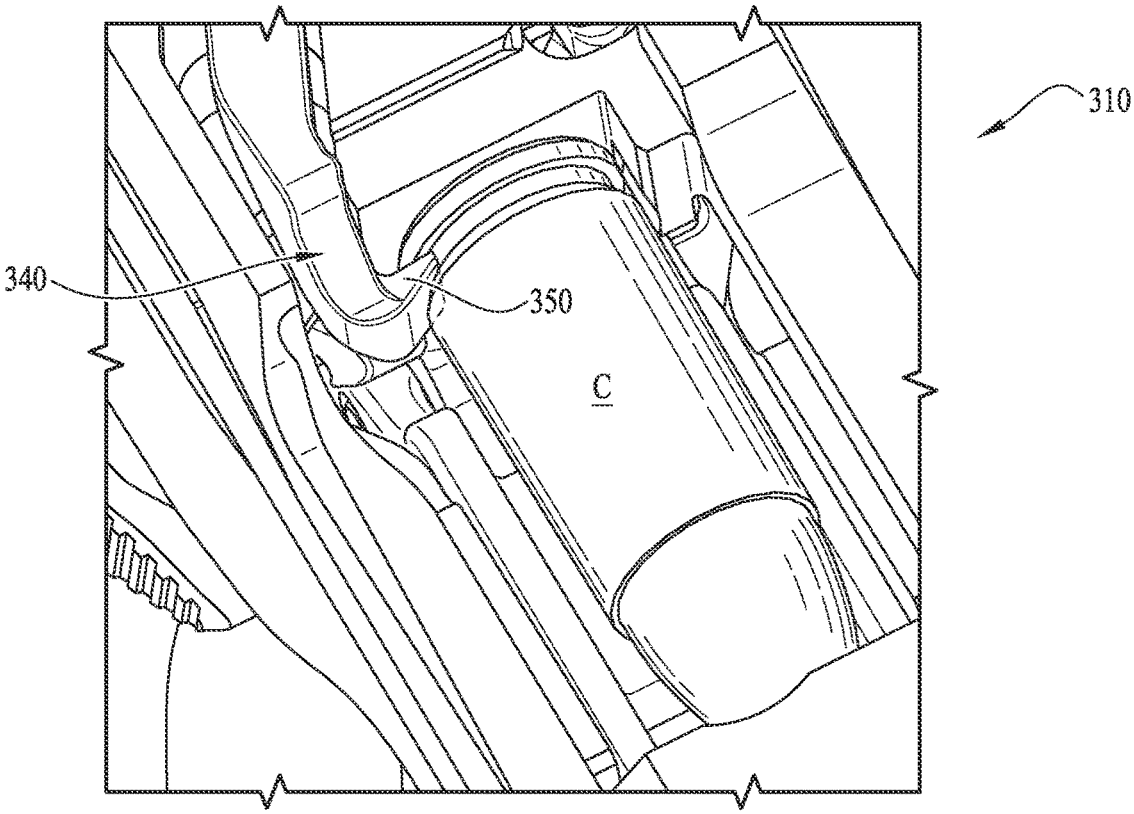
Figure 3D:
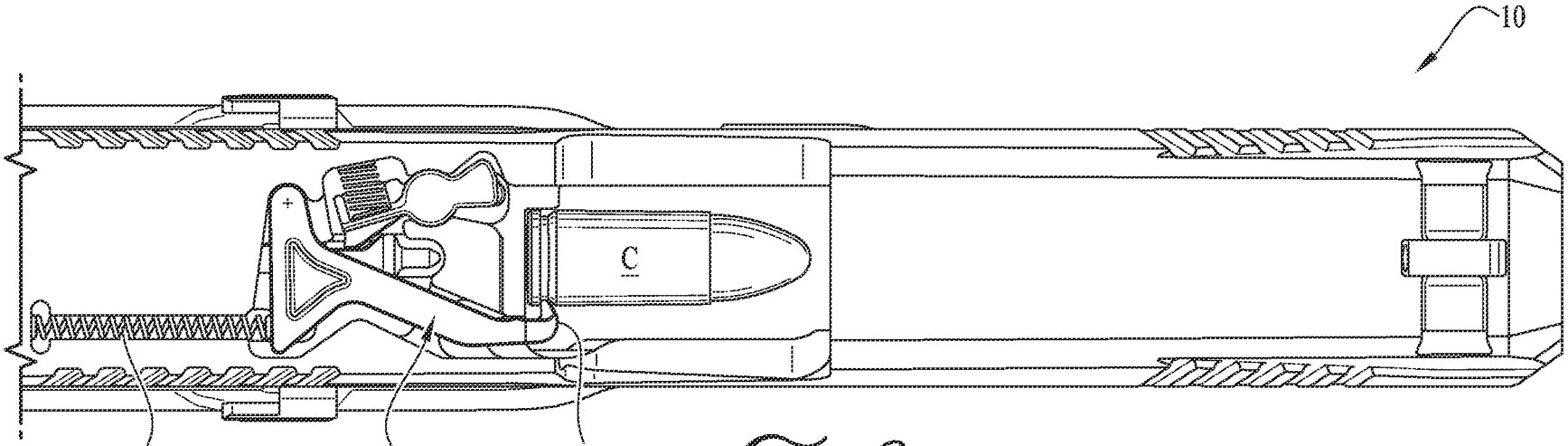
FIGS. 3D-3E show top detailed views of the firearm and the improved extractor configuration of FIGS. 3A-3C, and further showing the functionality thereof and the extractor's engagement/disengagement with a cartridge or casing.
Figure 3E:
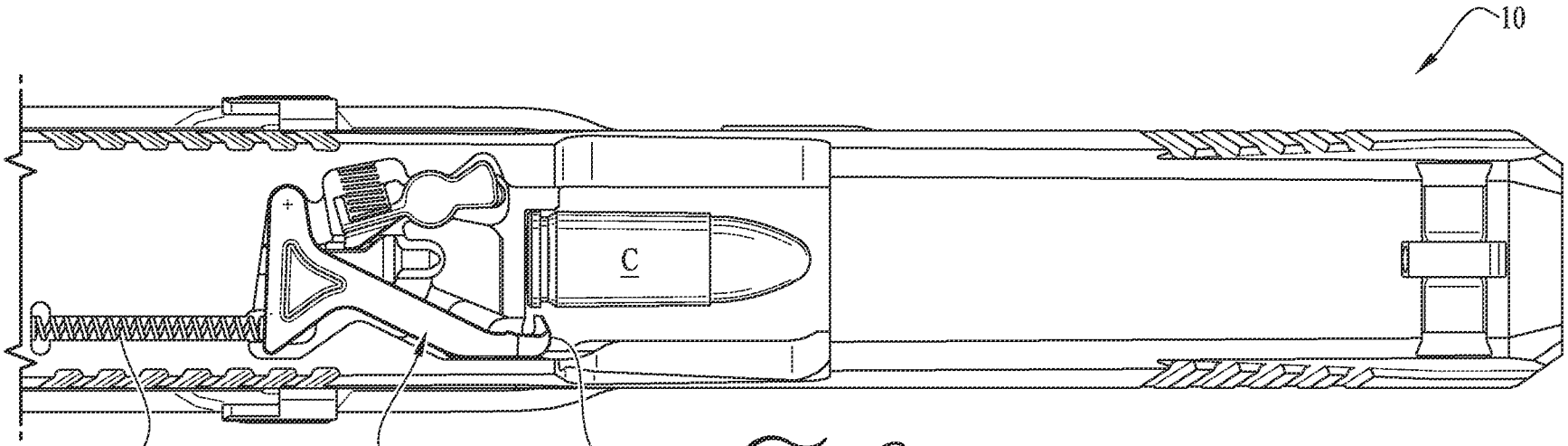

An elongated extractor arm 340 extends obliquely forward from the body portion 320 to a free end terminating in an extractor hook 350, defining a longitudinal moment arm. The extractor hook 350 is configured for engagement with the rim of the cartridge or casing C to retract the cartridge or casing rearward for extraction from the barrel of the firearm 10. The pivot axis 322 of the extractor mechanism 310 is positioned on a first side (left) of a medial plane or longitudinal bore axis extending along a longitudinal centerline 360 of the firearm's barrel, and the point of engagement of the tip of the extractor hook with the cartridge C is on an opposite second side (right) of the centerline 360, whereby the force vector applied by the extractor hook on the cartridge pulls across and into the body of the cartridge (see FIGS. 3A, 3B and 3F). In this manner, more positive engagement of the cartridge C by the extractor 310 is provided, whereby an increase in the retraction force applied results in an increased engagement area on the cartridge, increased engagement force, increased engagement force on the cartridge promoting maximum engagement area, and/or improved transfer of extraction force to the cartridge, thereby reducing the potential for disengagement and extraction and/or ejection failure. In the depicted embodiment, the extractor pivot 322 is integral to the extractor, but in other embodiments the pivot can be a separate component such as a pin.

Figure 3F:
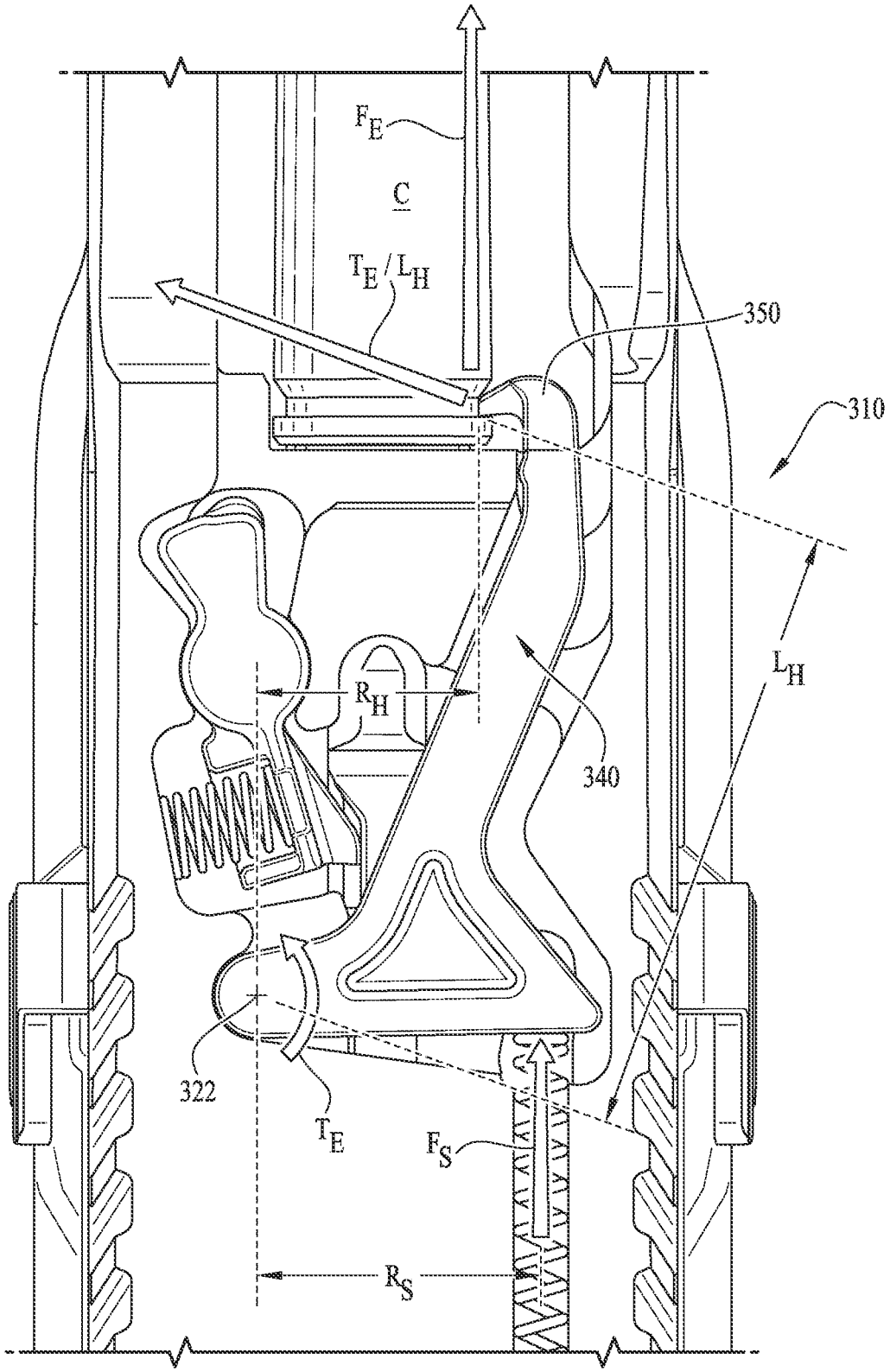
FIG. 3F shows a top detailed view of the improved extractor configuration, illustrating the force vectors being applied to and by the extractor and casing.

As depicted in FIG. 3F and noted above, the improved extractor mechanism 310 is configured so as to provide improvements to the positive engagement of the cartridge C by the extractor 310, for example, to receive and apply forces so as to result in an increased engagement area on the cartridge, increased engagement force, increased engagement force on the cartridge promoting maximum engagement area, and/or improved transfer of extraction force to the cartridge, thereby reducing the potential for disengagement and extraction and/or ejection failure. As depicted, the improved extractor mechanism 310 defines an extractor spring vector $F_S$, an extractor spring moment arm $R_S$, an extractor hook moment arm $R_H$, an extractor hook longitudinal moment $L_H$, an extractor moment $T_E$, a case extraction force $F_E$, and an extractor engagement force with case $T_E/L_H$. According to one example embodiment of the present invention, the extractor spring moment arm $R_S$ defines a dimension of about 13 millimeters, the extractor hook moment arm $R_H$ defines a dimension of about 9.4 millimeters, and the extractor hook longitudinal moment arm $L_H$ defines a distance of about 28.2 millimeters. According to other example embodiments of the present invention, the extractor spring moment arm $R_S$ defines a dimension of between about 10-16 millimeters, the extractor hook moment arm $R_H$ defines a dimension of about 6-12 millimeters, and the extractor hook longitudinal moment arm $L_H$ defines a distance of about 25-34 millimeters. According to yet another example embodiment, the extractor spring moment arm $R_S$, the extractor hook moment arm $R_H$, and the extractor hook longitudinal moment arm $L_H$ can be dimensioned as desired.

According to another example embodiment, the present invention relates to a firearm striker safety mechanism 410. As depicted in FIGS. 4A-4D the striker safety mechanism 410 preferably includes a direct trigger interface without intermediate linkages or components between the trigger 510 and a striker safety block 420 of the striker safety mechanism 410. In example embodiments, the elimination of intermediate linkages or components may improve reliability and/or reduce costs due to fewer parts. In example embodiments, the striker safety mechanism 410 includes a striker safety block 420 pivotally mounted to the firearm 10 about a striker safety axis 430 located at a medial portion of the striker safely block. According to example embodiments, a pin or post 432 extends downwardly from a lower side of the medial portion of the safety block, for example, which is axially aligned with the pivot axis 430, which is the portion about which the safety block 420 pivots (see FIGS. 5A-5B). In example embodiments, the slide/frame of the firearm 10 comprises a receiver, recess or other engagement portion for permitting pivotal engagement of the post 432 thereto. In alternate example embodiments, the post 432 may be in the form of a female receiver and a post or other pivotal engagement portion can be provided with the slide/frame, for example, so as to similarly provide for pivotally mounting the safety block 420 to the slide/frame.

Figure 4A:
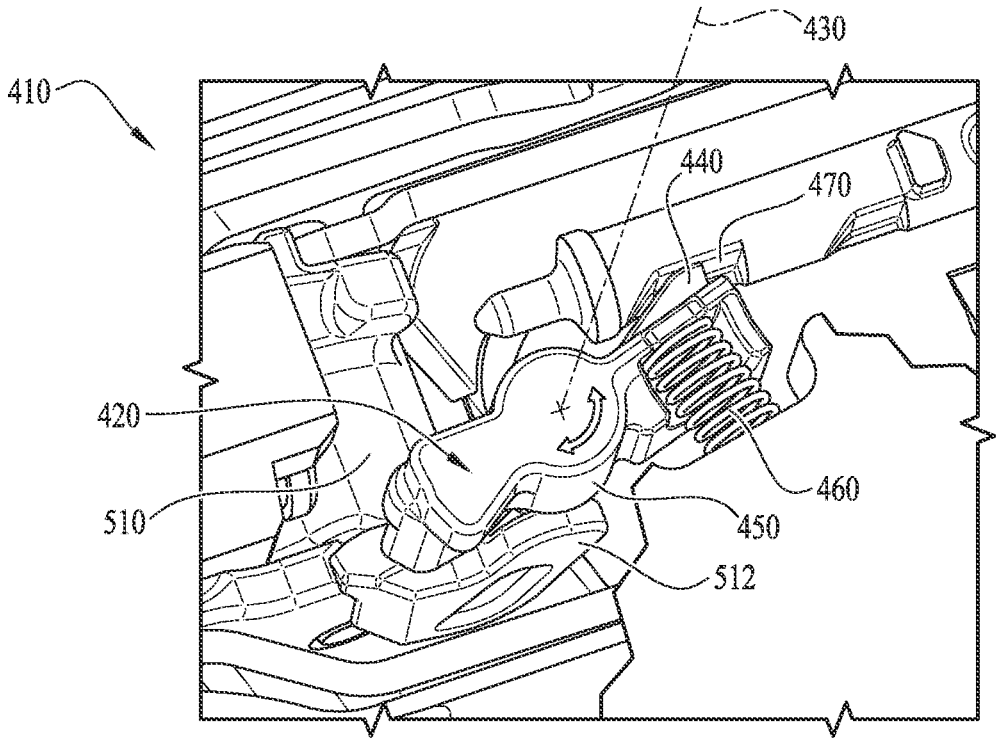
FIGS. 4A-4B show perspective views of a firearm striker safety with direct trigger interface according to an example embodiment of the present invention, showing a portion of the firearm striker safety engaged with a portion of a striker of the firearm, and showing the firearm striker safety disengaged with the striker of the firearm.
Figure 4B:
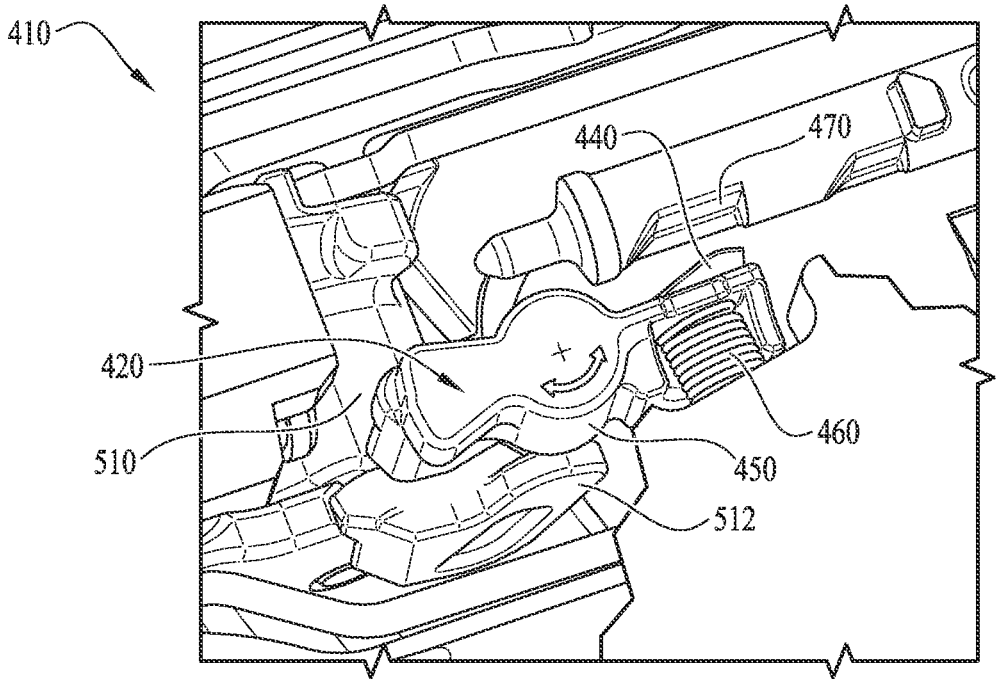
Figure 4D:
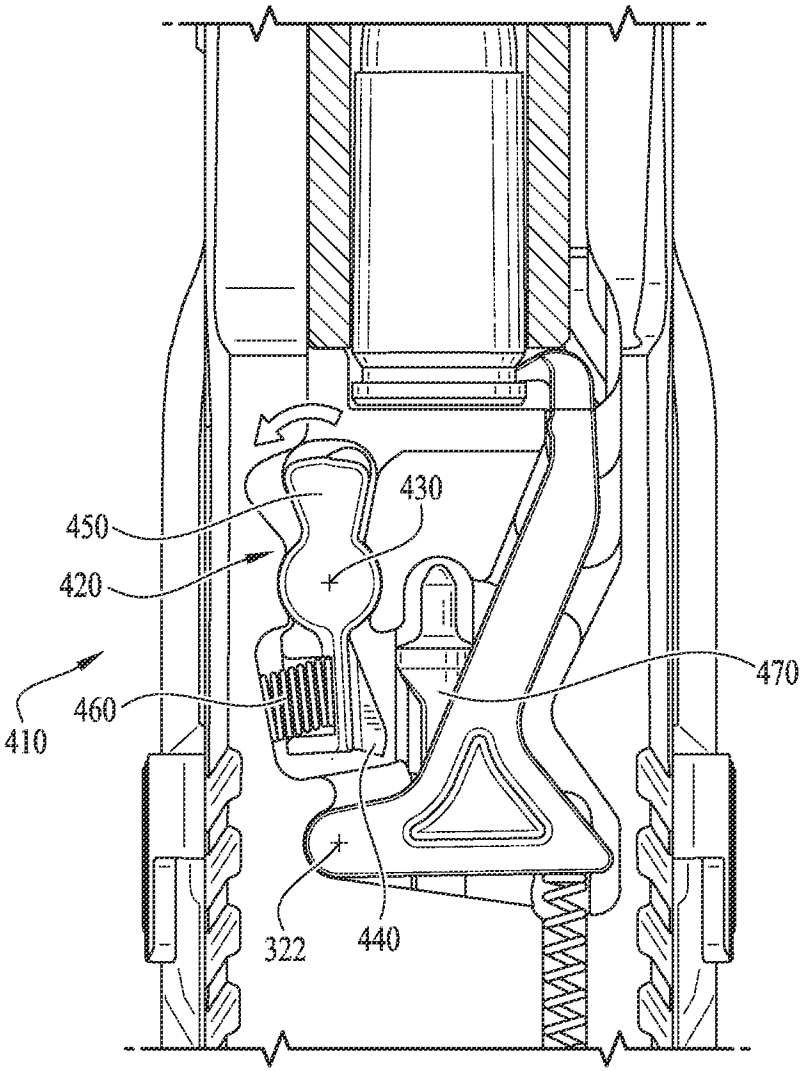
FIGS. 4C-4D show top views of the firearm striker safety with direct trigger interface of FIGS. 4A-4B.
Figure 4C:
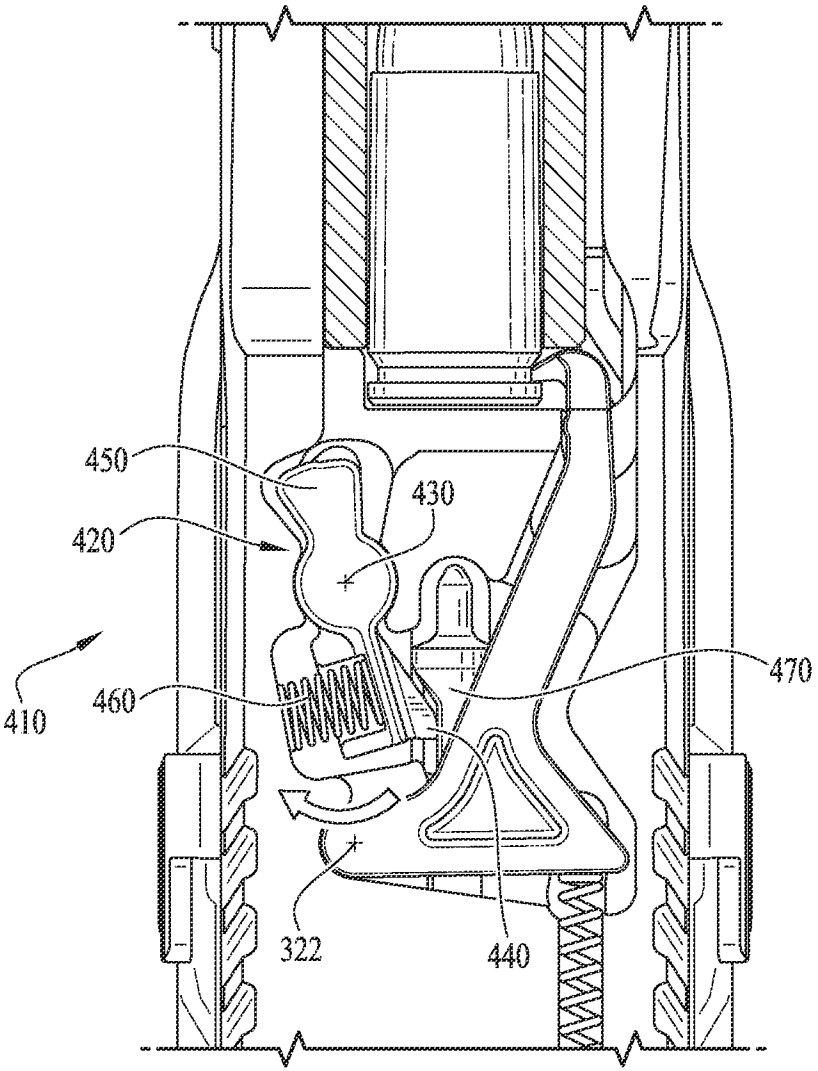

The striker safety block 420 comprises a striker engagement lobe portion 440 at a first end on a rearward side of the pivot axis 430, a trigger engagement lobe portion 450 at an opposite second end on a forward side of the pivot axis 430, and a spring or bias member seat 462 at the first end on a forward side of the pivot axis 430. A striker safety spring 460 biases the striker safety block to pivot the striker engagement portion 440 into abutment with a stop surface or shoulder formed in or on the striker or firing pin 470, as shown in FIGS. 4A and 4C, to prevent the striker from moving forward and thereby prevent firing of the firearm 10 when the trigger 510 is not pulled, for example due to inertia if the firearm is accidentally dropped. In alternate embodiments the spring may be of another kind or an integrated feature of the safety. When the trigger 510 is pulled, an upper finger 512 extending from the trigger 510 directly contacts the trigger engagement lobe portion 450 as shown in FIGS. 4B and 4D, and overcoming the bias of spring 460, pivots the striker safety block 420 to move the striker engagement portion 440 out of engagement with the stop surface of the striker 470, allowing the striker to advance and fire the firearm.

Figure 5A:
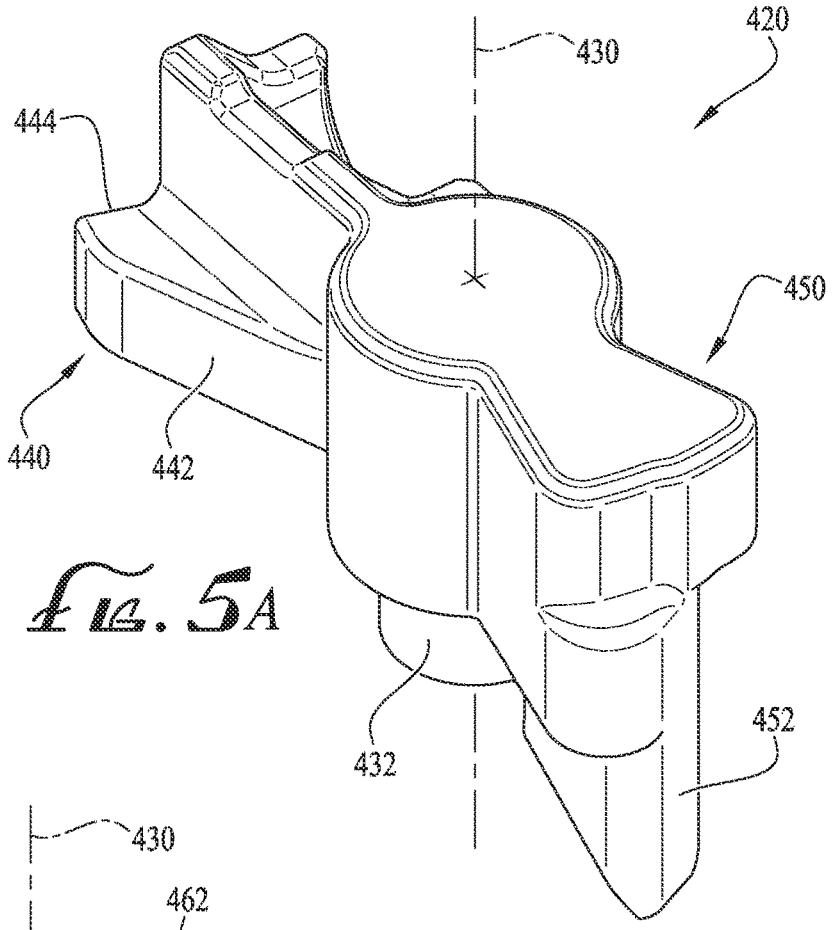
FIGS. 5A-5B show perspective views of a striker safety block of the firearm striker safety with direct trigger interface of FIGS. 4A-4D.
Figure 5B:
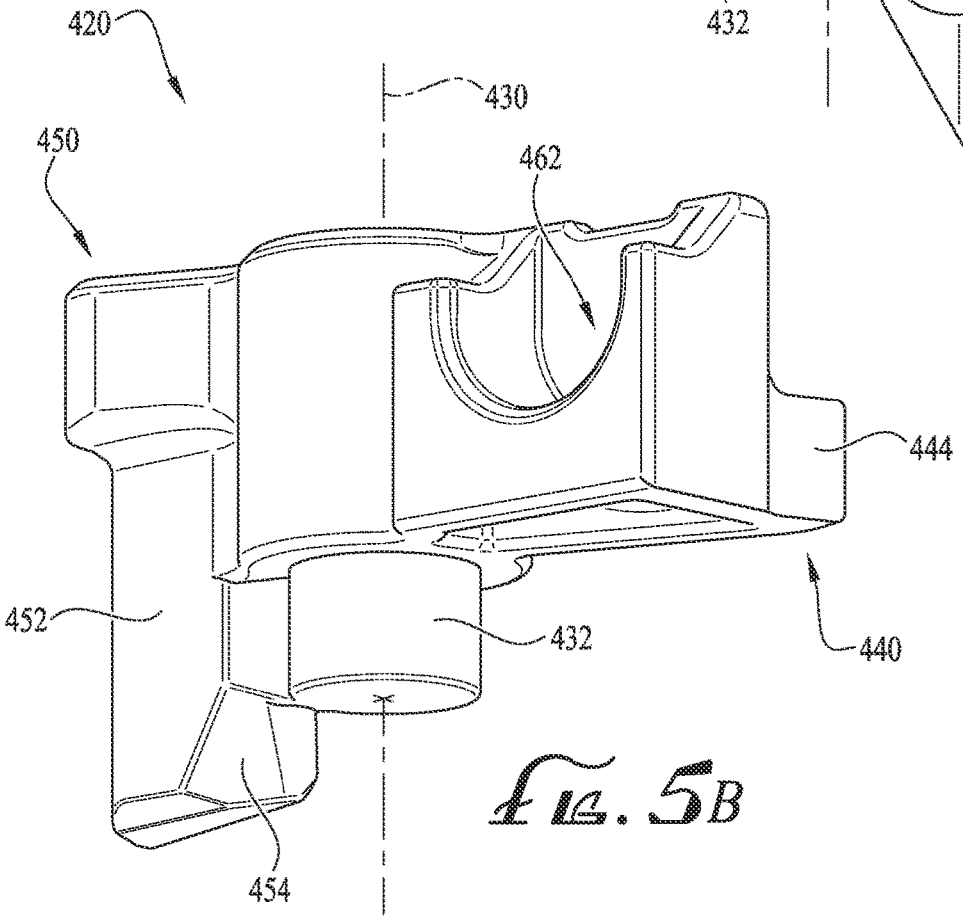
Figure 5C:
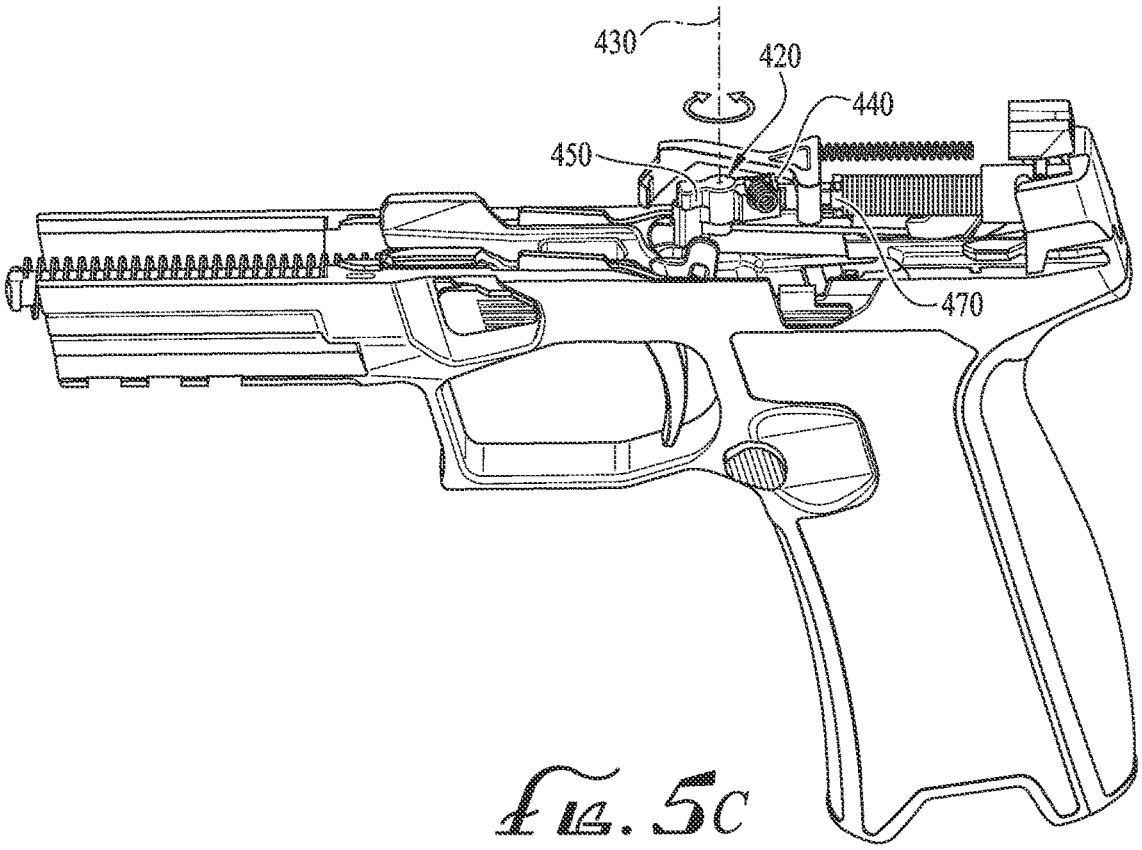
FIGS. 5C-5D show the striker safety mechanism with direct trigger interface of FIGS. 4A-4D, and further showing internal components of the firearm and their interengagement with the striker safety mechanism with direct trigger interface.
Figure 5D:
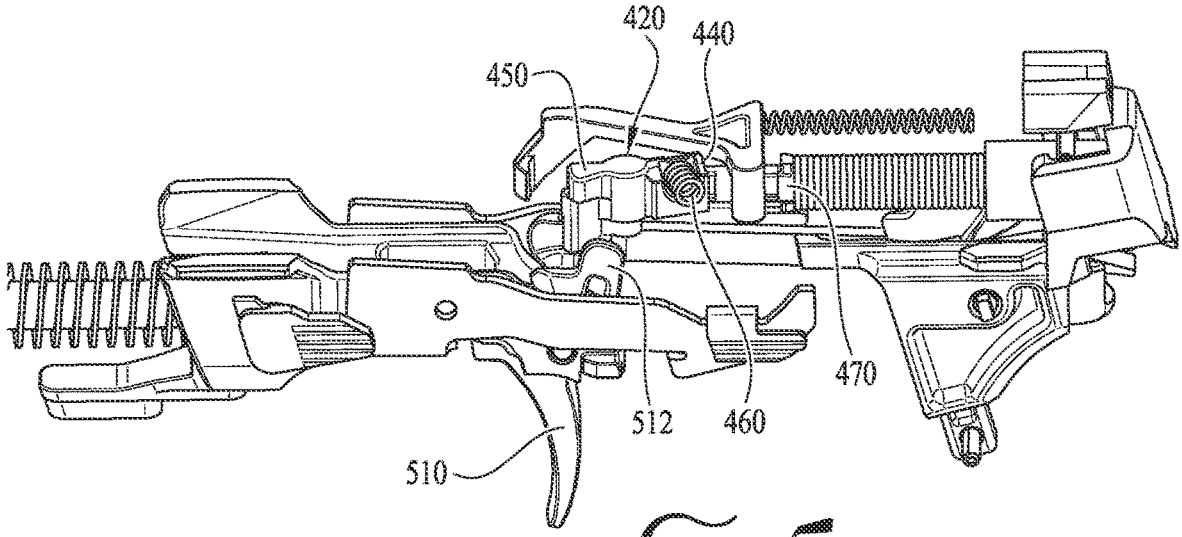

According to some example embodiments as depicted in FIGS. 5A-5B, the trigger engagement lobe portion 450 comprises a lower extension portion 452 having an upper finger engagement surface or chamfer 454. In some example embodiments, the chamfer 454 provides a direct engagement surface for contact by the upper finger 512 of the trigger 510. In some example embodiments, the chamfer 454 is generally angled relative to surfaces of the lower extension portion 452, ensuring that the upper finger 512 provides sufficient engagement therewith so as to ensure reliability. FIGS. 5C-5D show additional detail of the trigger 510 and striker safety block 420 and associated components of the firearm 10 according to an example embodiment of the invention. In alternate embodiments this improvement may be adapted to use in connection with a hammer fired gun. As used herein, the striker may optionally comprise a striker/firing pin, and all firing pin mechanisms are included.

According to another example embodiment, the present invention relates to a firearm sear 610 with direct striker (firing pin) 470 interface. As depicted in FIGS. 6A-6G, the sear 610 pivots downward in the rear to disengage from the firing pin 470. This allows the firing pin 470 to move forward under firing pin spring pressure and strike the cartridge C. The engagement point is circled in FIG. 6A. When the cartridge is detonated the pressures cause the slide of the firearm 10 to move to the rear (see FIG. 6D), extract and eject the empty cartridge case, and move forward again. During the time that the slide is reciprocating, the sear 610 is disconnected from a trigger bar 525 so that it can rotate back up and into position to catch the firing pin 470 and retain it in the cocked position (see FIG. 6A).

Typically, in most previous firearm mechanisms, a sear or sear feature of another component (e.g. trigger bar) typically must have something to arrest its pivoting motion and provide a somewhat consistent engagement with the firing pin. In existing designs that stopping point is typically somewhere in the frame—either a pin, molded surface, or a machined surface or something similar in the frame that stops it. The slide and the frame necessarily have some clearance between them. Intermediate parts connecting the slide and the frame will each present additional tolerances to account for, resulting in less consistent engagement distance. Other components that may be involved can include but are not limited to trigger/fire control/sear housings, grip, frame, slide, striker, striker sleeve, striker housing, and trigger bar. Therefore the consistency of engagement in previously known designs could be improved, since the sear is stopped by the frame and the firing pin rides in the slide.

Figure 6A:
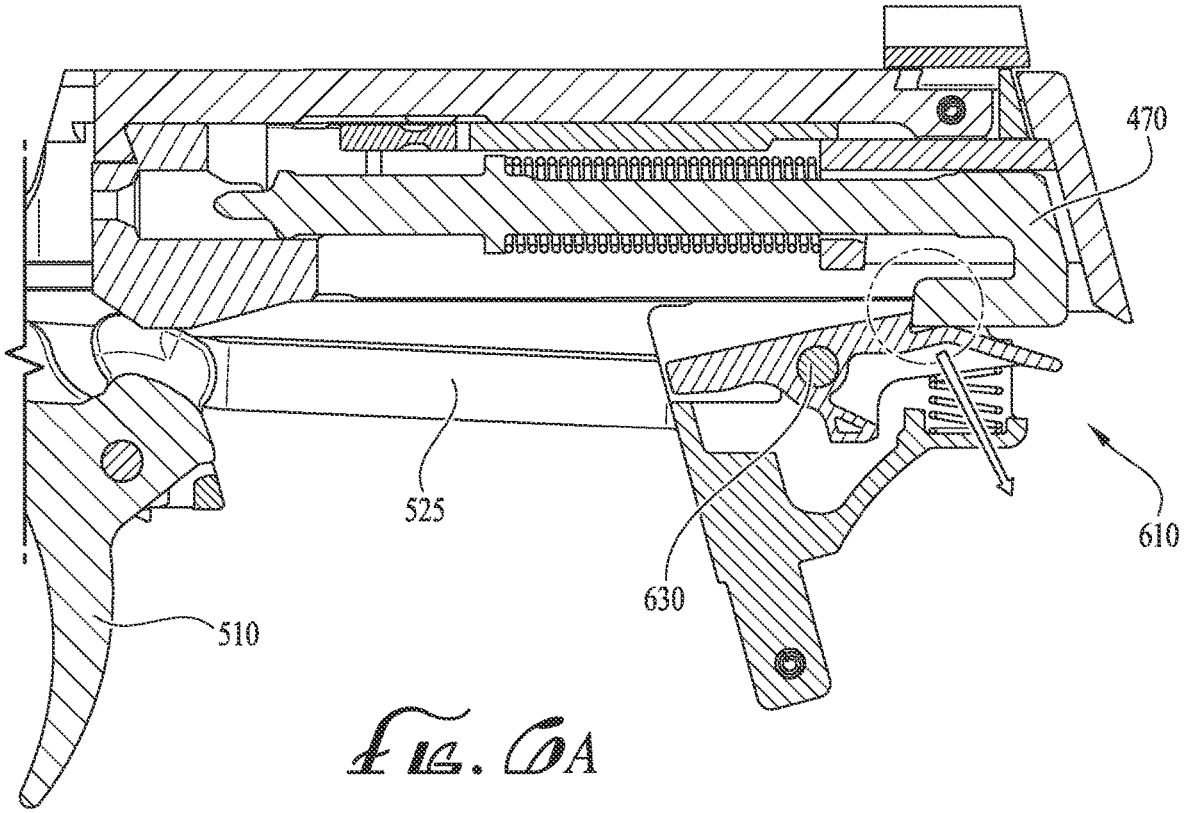
FIG. 6A shows a cross-sectional view of a portion of a firearm having a firearm sear with direct striker interface according to an example embodiment of the present invention, showing the firearm sear engaged with a portion of the striker in the cocked position.
Figure 10B:
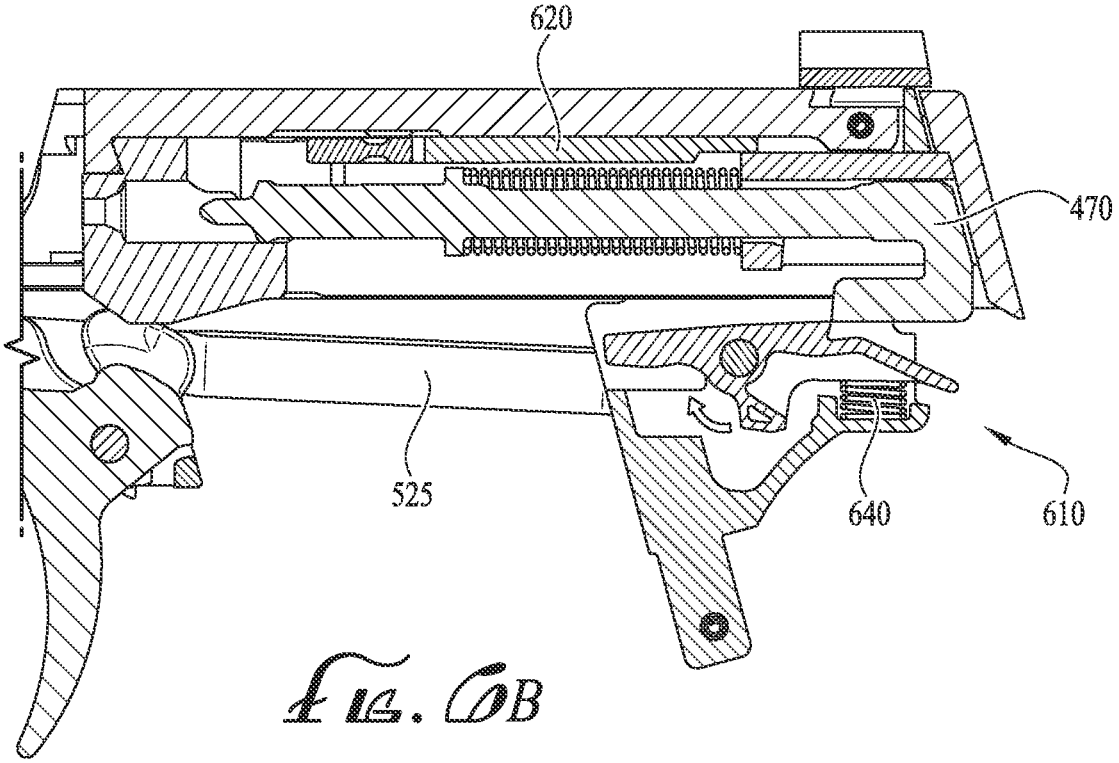
Figure 10C:
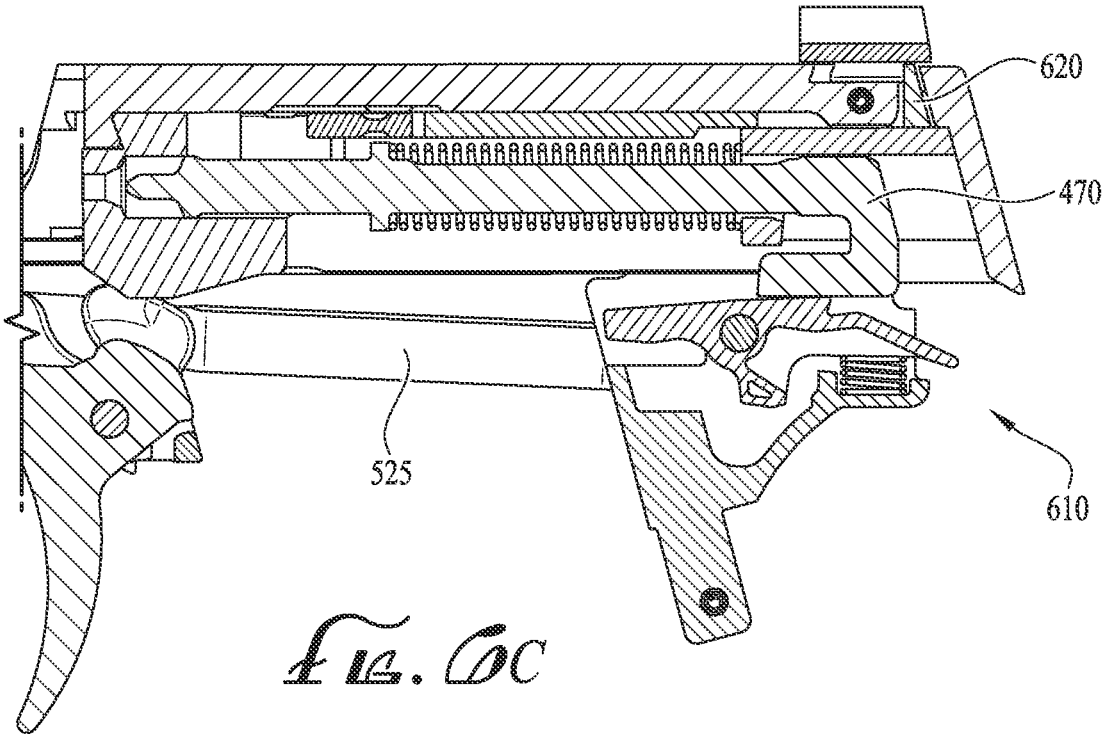
Figure 6D:
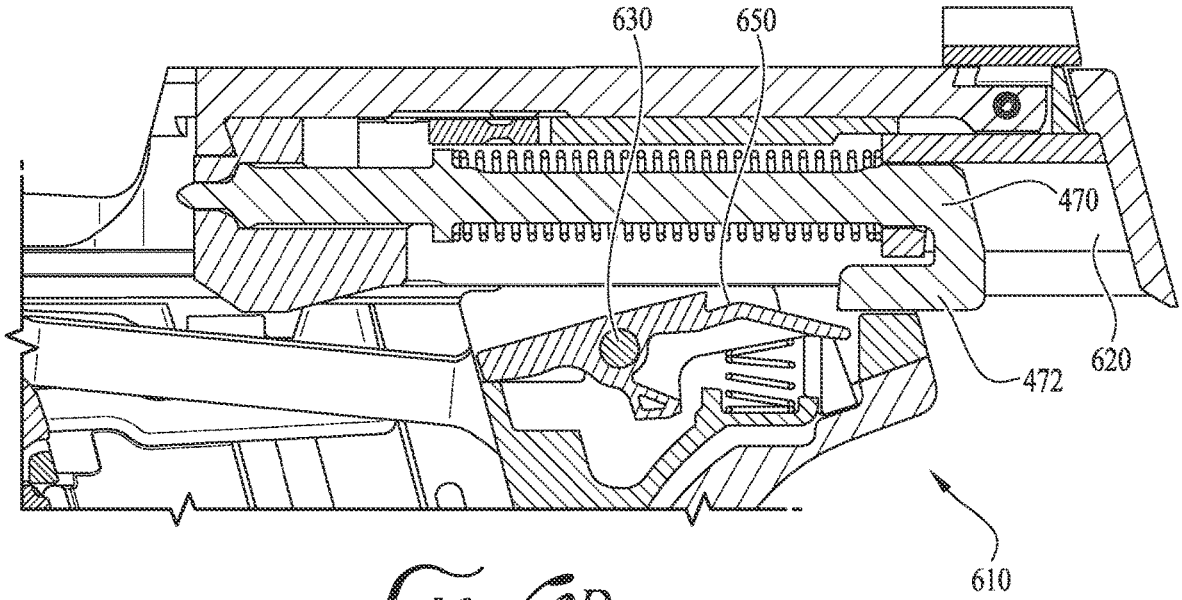
Figure 6E:
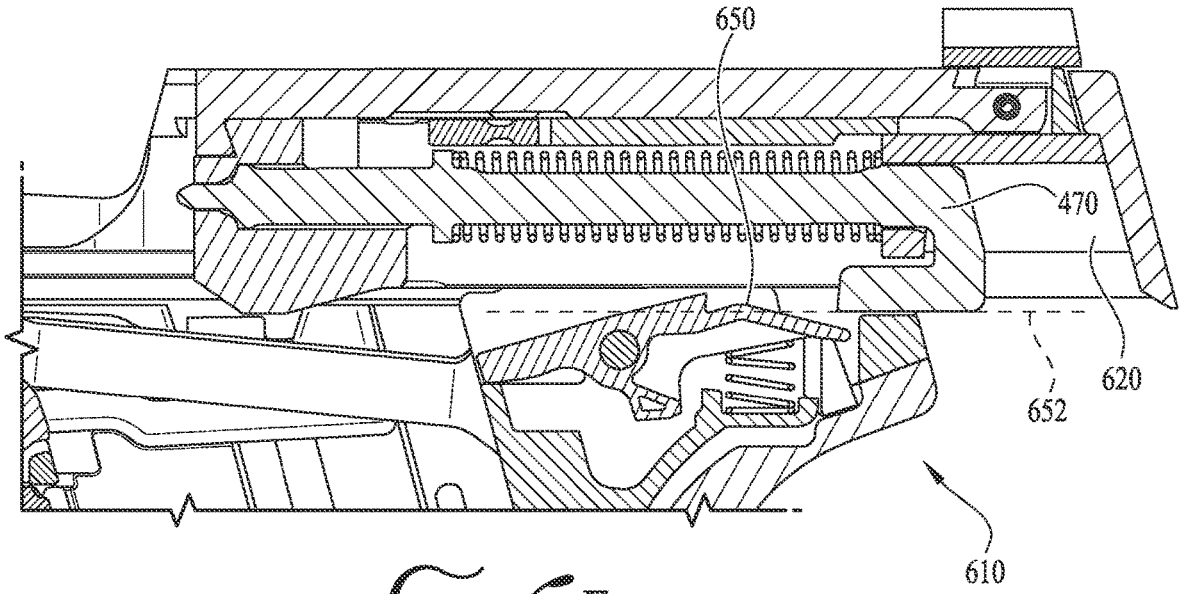
FIG. 6E shows the cross-sectional view of the firearm having a firearm sear with direct striker interface of FIG. 6D, showing a plane that is defined at a lowermost portion of an extension finger of the striker and its interference with a ramp of the sear.

According to example embodiments of the present invention, the sear 610 is rotated downward as in conventional pistols, releasing the firing pin 470 and the reciprocating action of the slide 620 begins (see FIGS. 6B-6C). The sear 610 is disconnected from the trigger bar 525 and the rear part of the sear 610 (behind the pivot pin 630) moves upwards under sear spring 640 pressure to engage the firing pin 470 (see FIG. 6A). For example, as depicted in FIGS. 6A & 6C, the rear portion of the sear 610 is elongated and has a shallow ramp 650 incorporated in it, behind the pivot pin 630, and a catch 654 is formed generally at a forward portion of the ramp 650 for engagement with an extension finger 472 of the firing pin 470. In example embodiments, the extension finger 472 of the firing pin 470 directly engages this ramp 650 of the sear 610 and depresses the ramp slightly as it engages. As depicted in FIG. 6E, a lowermost portion of the extension finger (defined by plane 652) is at least partially interfering with the ramp 650 of the sear 610. The sear spring 640 biases the rear part of the sear 610 upward, and contact of the firing pin extension finger 472 on the ramp 650 of the sear provides a controlled downward movement (see direction arrow of FIG. 6A) of the rear part of the sear 610 against the spring bias, resulting in a very precise and consistent seating between the sear 610 and the firing pin 470 in the cocked position. As a result, the engagement of the sear and the firing pin is very consistent and self-correcting, regardless of any play that exists between the slide and the frame. This consistent engagement results in a very consistent feel to the trigger pull, increasing the practical accuracy and "shootability" of the firearm 10, and also improves the safety of the firearm as the sear engagement is minimally affected by component tolerances.

Figure 6F:
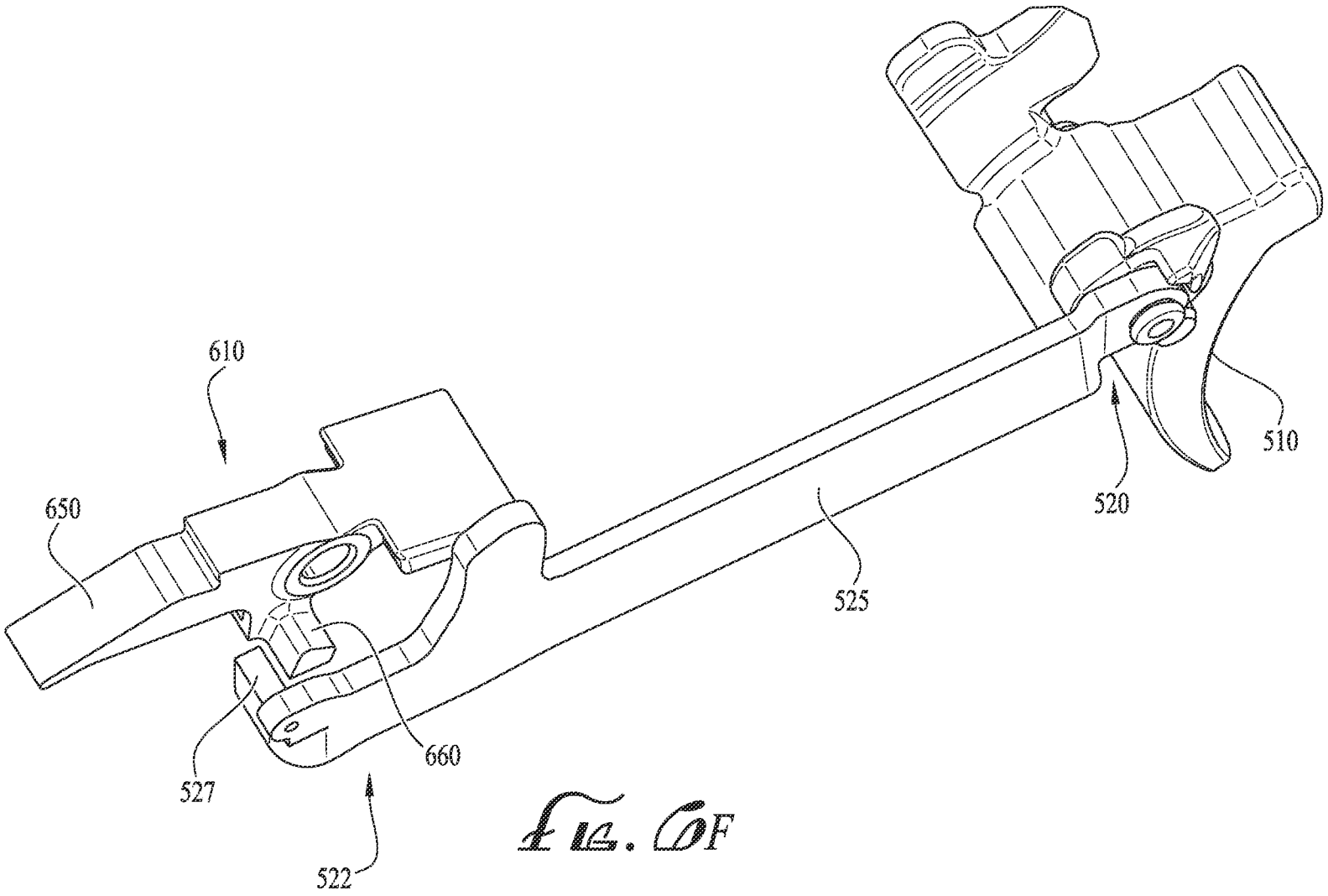
FIG. 6F shows a top perspective view of the firearm sear, and a trigger bar and trigger thereof configured for interengagement therewith.
Figure 6G:
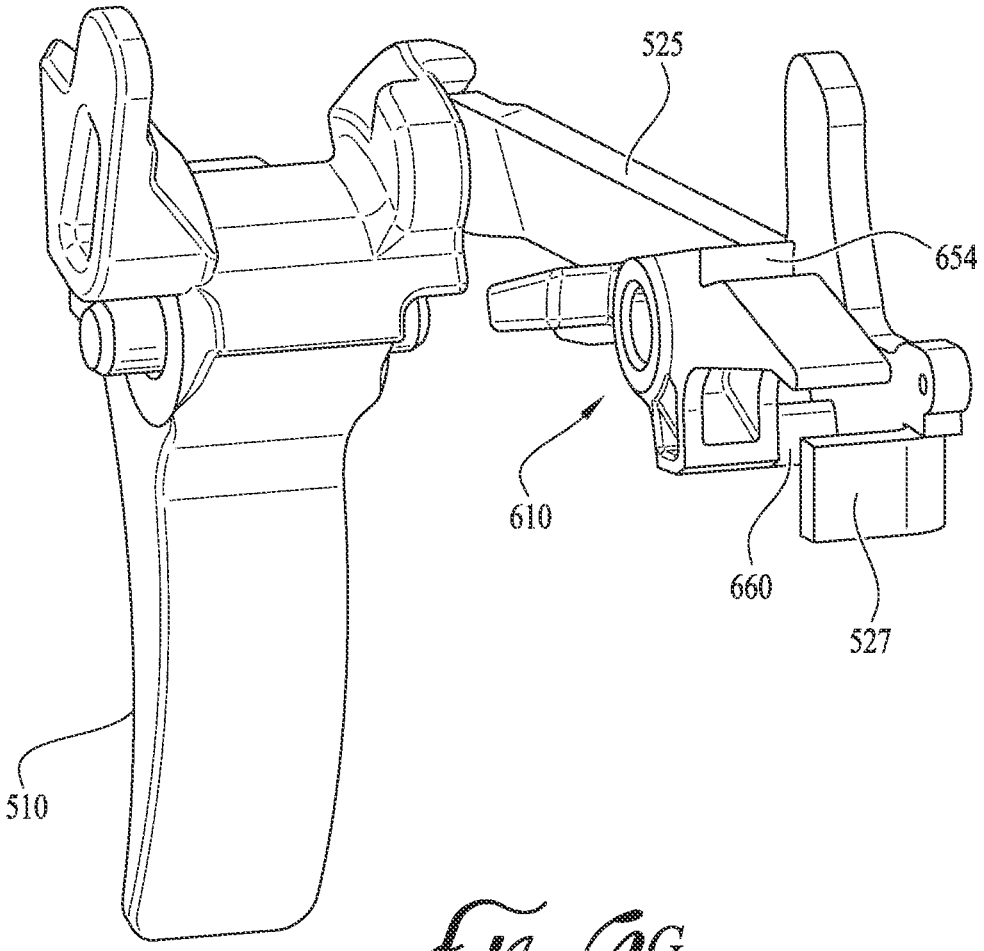
FIG. 6G shows a rear perspective view of the firearm sear, trigger bar and trigger of FIG. 6F.

FIGS. 6F-6G show further details of the interengagement between the trigger 510, the trigger bar 525 and the sear 610. For example, according to example embodiments, the trigger bar 525 comprises a first end 520 pivotally coupled to a portion of the trigger 510 and a second end 522 comprising a release finger 527. The sear 610 comprises an engagement portion or release component 660 that is generally provided near a medial portion thereof, for example, so that pulling of the trigger 510 causes forward movement of the trigger bar 525, thereby causing the release finger 527 to contact the release component 660 of the sear 610, causing the sear 610 to pivot about the pivot pin 630 and release the catch 654 from the firing pin extension finger 472 such that the firing pin 470 can move forward under firing pin spring pressure and strike the cartridge C.

According to another example embodiment, the present invention relates to a firearm striker or firing pin 470 and a striker or firing pin spring 710, and for example relates to the engagement of the firing pin spring 710 onto the firing pin 470 of a firearm. Typically, the firing pin spring of many previously known firearms is mounted to the firing pin by compressing the spring onto the firing pin and installing separate small retainer pieces to hold the spring on the firing pin. The retainer pieces are easily lost, and the process of assembly can require special tools, and be difficult and/or hazardous.

In example embodiments, the firing pin 470 comprises a generally elongate member comprising a forward end, a rearward end, and one or more integral and/or unitary spring retention members or ears extending from the elongate member. In the depicted embodiment, a pair of two radially outwardly projecting spring retention ears 720 are integrally formed with the firing pin 470 on laterally opposite locations toward a forward end of the firing pin 470 (see FIG. 7A). The spring retention ears 720 optionally include an obliquely inclined or ramped first side face or bevel 722, and a flat circumferentially aligned contact face 724 for engagement with the spring 710 during installation and use.

Figure 7A:
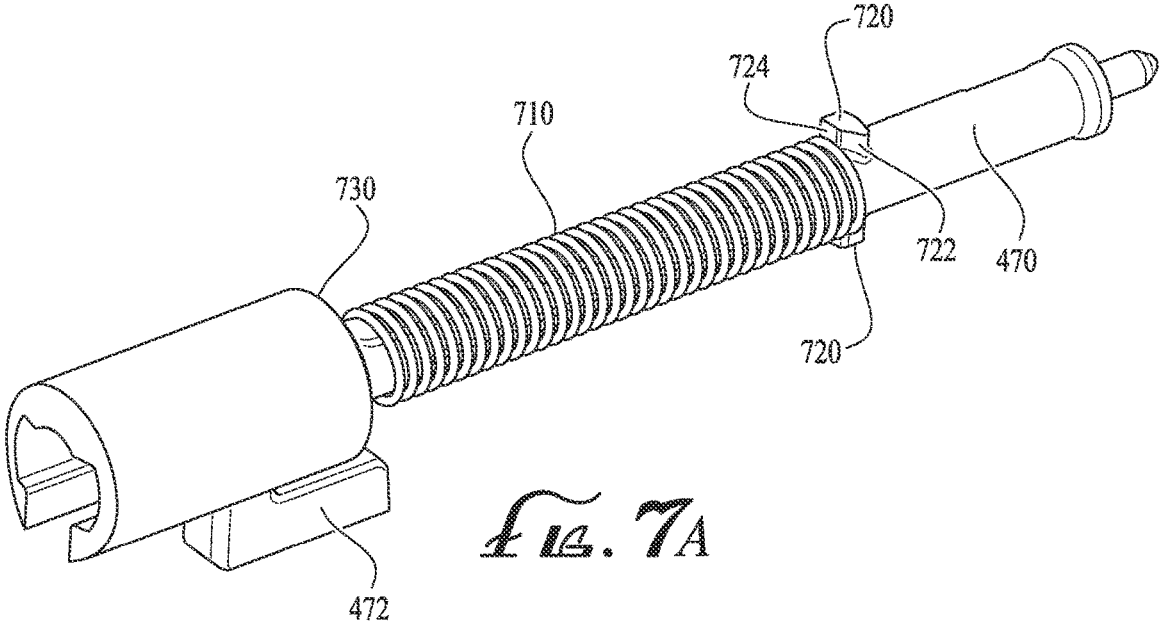
FIG. 7A shows a perspective view of a firearm striker and striker spring according to an example embodiment of the present invention.
Figure 7B:
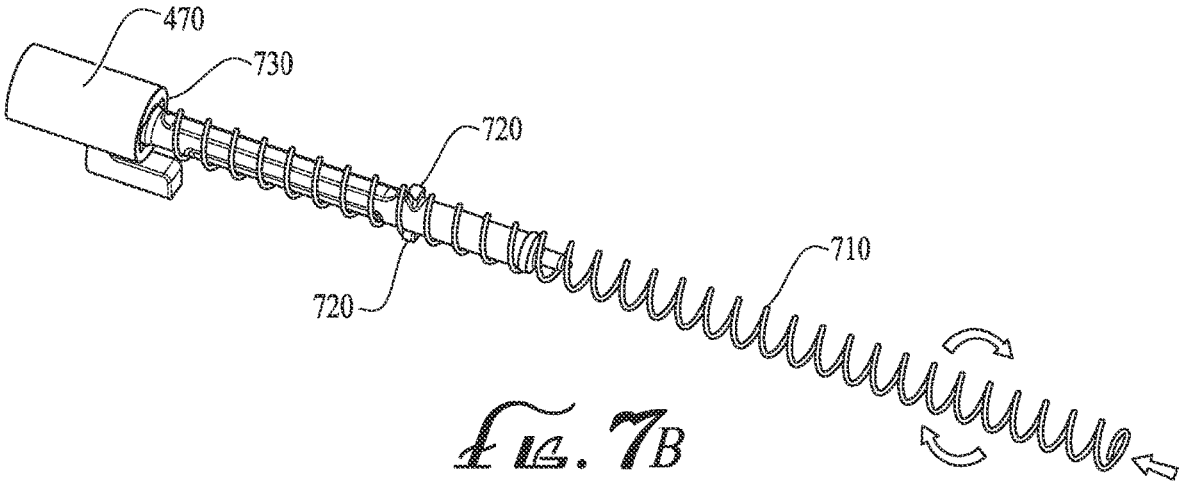
FIG. 7B shows the firearm striker and striker spring of FIG. 7A, showing the striker spring being installed with the striker spring according to an example embodiment of the present invention.

As shown in FIG. 7B, the firing pin spring 710 is installed by placing a first end of the spring over the front end of the firing pin 470, into contact with the spring retention ears 720. The spring 710 is then helically threaded over the spring retention ears 720 onto the firing pin 470. As the spring 710 is twisted onto the firing pin 470, the rotation of the spring 710 compresses the back end of the spring behind the retention ears 720 and against a rear spring abutment face 730 which in this embodiment is a separate component (the striker sleeve). When the spring 710 is completely wound onto the firing pin, the forward end of the spring is retained in place on the firing pin 470 by abutment of the front end of the spring against the integral retention ears 720 as shown in FIG. 7A. The flat circumferentially aligned contact face 724 of the retention ears 720 prevents the spring 710 from unwinding off of the firing pin 470 unless the spring is intentionally removed (this is primarily achieved by the closed coil end condition of the spring 710, whereby the final "dead" coil needs to be manually expanded to allow it to be "unthreaded" from the striker). The ears 720 also act as the driving feature whereby the stored energy of the striker spring is delivered to the striker by forcibly acting on those ears directly.

The present invention includes each of the various features, components and systems disclosed, independently and/or in any combination(s) thereof. The invention further includes a firearm incorporating any of the various features, components and systems disclosed, independently and/or in any combination(s); as well as any of the features, components and systems described and shown provided separately, for example as repair or retrofit parts for a firearm. And while example embodiments are depicted in the form of a semi-automatic handgun or pistol format, the various features, components and systems disclosed may be incorporated into various different firearm formats within the scope of the invention.

While the invention has been described with reference to example embodiments, it will be understood by those skilled in the art that a variety of modifications, additions and deletions are within the scope of the invention, as defined by the following claims.

What is claimed is:

1. An extractor mechanism for a firearm, the extractor mechanism comprising:

a body portion pivotally mounted to a slide of the firearm for pivotal motion about a pivot axis extending through a proximal lobe of the body portion, the pivot axis being oriented generally perpendicular relative to a longitudinal bore axis of a barrel of the firearm;

an extractor spring attached to a distal lobe of the body, the distal lobe of the body being positioned at a lateral offset distance from the pivot axis to define an extractor spring moment arm;

an elongated extractor arm extending obliquely forward from the body portion to a free end terminating in an extractor hook comprising a tip, the extractor hook configured for engagement with a rim of a cartridge to retract the cartridge rearwardly for extraction from the barrel of the firearm;

wherein the pivot axis of the body portion of the extractor mechanism is positioned on a first side of the longitudinal bore axis and the point of engagement of the tip of the extractor hook with the cartridge is on an opposite second side of the longitudinal bore axis, and wherein a force vector applied by the extractor hook on the cartridge pulls across and into the body of the cartridge.

2. The extractor mechanism of claim 1, wherein the direction of the force vector pulling across and into the body of the cartridge provides increased engagement force on the cartridge promoting maximum engagement area, and/or improved transfer of extraction force to the cartridge, thereby reducing the potential for disengagement and extraction and/or ejection failure.

3. The extractor mechanism of claim 1, wherein the proximal lobe and pivot axis thereof are integrally formed with the body portion.

4. The extractor mechanism of claim 1, wherein the proximal lobe and/or pivot axis of the body portion are separate components assembled with the body portion.

5. The extractor mechanism of claim 1, wherein the body portion is generally triangular in shape.

6. A firearm comprising the extractor mechanism of claim 1.

7. The firearm of claim 6, further comprising a slide cover removably connected to a slide of the firearm, the slide cover comprising an engagement portion configured for interchangeable engagement with a plurality of sights or aiming devices of various different formats.

8. The firearm of claim 6, further comprising a striker safety mechanism configured to prevent firing of the firearm when a trigger of the firearm is not pulled.

9. The firearm of claim 6, further comprising a striker comprising a generally elongate member comprising a forward end, a rearward end comprising a rear spring abutment face, one or more integral spring retention members extending from the elongate member, and a striker spring retained between the rear spring abutment face and the one or more integral spring retention members.

10. The firearm of claim 6, further comprising a sear comprising a forward portion, an elongated rearward portion defining a shallow ramp and catch adjacent thereto, and a sear pivot axis generally defined between the forward and rearward portions for pivotally mounting the sear within a portion of a firearm, the elongated rearward portion being biased upwardly by a sear spring, wherein an extension finger of a striker is configured for precise and consistent engagement with the catch of the sear, thereby providing a consistent trigger pull and improved accuracy.

* * * * *